US008767975B2

(12) United States Patent
Short

(10) Patent No.: US 8,767,975 B2
(45) Date of Patent: Jul. 1, 2014

(54) SOUND DISCRIMINATION METHOD AND APPARATUS

(75) Inventor: William R. Short, Southboro, MA (US)

(73) Assignee: Bose Corporation, Framingham, MA (US)

( * ) Notice: Subject to any disclaimer, the term of this patent is extended or adjusted under 35 U.S.C. 154(b) by 1766 days.

(21) Appl. No.: 11/766,622

(22) Filed: Jun. 21, 2007

(65) Prior Publication Data

US 2008/0317260 A1 Dec. 25, 2008

(51) Int. Cl.
*H04R 3/00* (2006.01)

(52) U.S. Cl.
USPC ..... 381/92; 381/98; 381/111

(58) Field of Classification Search
CPC ..... H04R 3/005; H04R 3/04; H04R 3/00; H04R 3/14; H04R 1/406; H04R 1/08; H04R 1/04; H04R 2201/401; H04R 25/407; G06F 17/141; G06F 17/14; G01L 21/02; G01L 2021/02161; G01H 3/14
USPC ..... 381/92, 99, 98, 91, 122, 111, 56; 708/821, 820, 801
See application file for complete search history.

(56) References Cited

U.S. PATENT DOCUMENTS

| | | | | |
|---|---|---|---|---|
| 4,066,842 A | | 1/1978 | Allen | |
| 4,485,484 A | | 11/1984 | Flanagan | |
| 4,653,102 A | | 3/1987 | Hansen | |
| 4,731,847 A | * | 3/1988 | Lybrook et al. | 704/260 |
| 4,904,078 A | | 2/1990 | Gorike | |
| 5,051,964 A | | 9/1991 | Sasaki | |
| 5,181,252 A | | 1/1993 | Sapiejewski et al. | |
| 5,197,098 A | | 3/1993 | Drapeau | |
| 5,479,522 A | | 12/1995 | Lindemann et al. | |
| 5,550,924 A | | 8/1996 | Helf et al. | |
| 5,651,071 A | | 7/1997 | Lindemann et al. | |
| 5,757,937 A | | 5/1998 | Itoh et al. | |

(Continued)

FOREIGN PATENT DOCUMENTS

| | | |
|---|---|---|
| CN | 1261759 A | 8/2000 |
| CN | 1998265A A | 7/2007 |

(Continued)

OTHER PUBLICATIONS

M. Nilsson, Ph. D., Sonic Innovations, Salt Lake City, Utah Topic: Sonic Innovations new product—Innova Feb. 28, 2005, http://www.audiologyonline.com/interview/displayarchives.asp?interviewid=324.

(Continued)

*Primary Examiner* — Vivian Chin
*Assistant Examiner* — Con P Tran

(57) ABSTRACT

A method of distinguishing sound sources includes the step of transforming data, collected by at least two transducers which each react to a characteristic of an acoustic wave, into signals for each transducer location. The transducers are separated by a distance of less than about 70 mm or greater than about 90 mm. The signals are separated into a plurality of frequency bands for each transducer location. For each band a comparison is made of the relationship of the magnitudes of the signals for the transducer locations with a threshold value. A relative gain change is caused between those frequency bands whose magnitude relationship falls on one side of the threshold value and those frequency bands whose magnitude relationship falls on the other side of the threshold value. As such, sound sources are discriminated from each other based, on their distance from the transducers.

23 Claims, 16 Drawing Sheets

(56) References Cited

U.S. PATENT DOCUMENTS

| | | | | |
|---|---|---|---|---|
| 5,778,082 | A | 7/1998 | Chu et al. | |
| 5,815,582 | A | 9/1998 | Claybaugh et al. | |
| 5,901,232 | A | 5/1999 | Gibbs | |
| 6,137,887 | A | 10/2000 | Anderson | |
| 6,198,830 | B1 | 3/2001 | Holube et al. | |
| 6,222,927 | B1 | 4/2001 | Feng et al. | |
| 6,549,630 | B1 | 4/2003 | Bobisuthi | |
| 6,594,365 | B1 | 7/2003 | Eatwell | |
| 6,704,428 | B1 | 3/2004 | Wurtz | |
| 6,823,176 | B2 | 11/2004 | Rogers | |
| 6,888,945 | B2 | 5/2005 | Horrall | |
| 6,912,178 | B2 | 6/2005 | Chu et al. | |
| 6,978,159 | B2 | 12/2005 | Feng et al. | |
| 6,983,055 | B2 | 1/2006 | Luo | |
| 6,987,856 | B1 | 1/2006 | Feng et al. | |
| 7,013,015 | B2 | 3/2006 | Hohmann et al. | |
| 7,065,219 | B1 | 6/2006 | Abe et al. | |
| 7,346,175 | B2 | 3/2008 | Hui et al. | |
| 2002/0150261 | A1 | 10/2002 | Moeller et al. | |
| 2003/0002692 | A1 | 1/2003 | McKitrick et al. | |
| 2003/0091199 | A1 | 5/2003 | Horrall et al. | |
| 2003/0228023 | A1 | 12/2003 | Burnett et al. | |
| 2004/0125922 | A1 | 7/2004 | Specht | |
| 2004/0179699 | A1 | 9/2004 | Moeller et al. | |
| 2005/0232440 | A1 | 10/2005 | Roovers | |
| 2005/0249361 | A1 | 11/2005 | Beavis et al. | |
| 2005/0276419 | A1 | 12/2005 | Eggert et al. | |
| 2006/0013409 | A1 | 1/2006 | Desloge | |
| 2006/0050898 | A1 | 3/2006 | Yamada et al. | |
| 2006/0109983 | A1 | 5/2006 | Young et al. | |
| 2007/0050176 | A1* | 3/2007 | Taenzer et al. | 702/189 |
| 2007/0253569 | A1 | 11/2007 | Bose | |
| 2008/0013762 | A1 | 1/2008 | Roeck et al. | |
| 2008/0170718 | A1 | 7/2008 | Faller | |

FOREIGN PATENT DOCUMENTS

| | | | |
|---|---|---|---|
| EP | 1489596 | | 12/2004 |
| EP | 1600791 | | 11/2005 |
| GB | 806261 | A | 12/1958 |
| GB | 2394589 | | 4/2004 |
| JP | 06-233388 | | 8/1994 |
| JP | 2000-270391 | | 9/2000 |
| JP | 2004-289762 | A | 10/2004 |
| JP | 2006-267444 | A | 10/2006 |
| JP | 2007-135046 | A | 5/2007 |
| WO | 2006/026812 | | 3/2006 |
| WO | 2006028587 | | 3/2006 |
| WO | 2007137364 | | 12/2007 |

OTHER PUBLICATIONS

Aarabi, Phase-Based Dual-Microphone Robust Speech Enhancement, IEEE Transactions on Systems, Man, and Cybernetics—Part B: Cybernetics, vol. 34, No. 4, Aug. 2004, pp. 1763-1773.

Mungamura, et al., Enhanced Sound Localization, IEEE Transactions on Systems, Man, and Cybernetics—Part B: Cybernetics, vol. 34, No. 3, Jun. 2004, 1083-4419/04$20.00 © 2004 IEEE, pp. 1526-1540.

Wittkop, et al., Stategy-selective noise reduction for binaural digital hearing aides, NH Elsevier, Speech Communication 39(2003) 111-138, www.elsevier.com/located/specom, Medizinische Physik, Universitat Oldenburg, D-26111, Germany, Copyright 2002.

Wittkop, Two-channel noise reduction algorithms motivated by models of binaural interaction, Sep. 9, 1968, Hamburg, Germany, Chapter 3, pp. 39-59.

International Report on Patentability dated Nov. 4, 2010, for PCT/US2009/037503, 7 pages.

Shulman, Uri, Shure Brothers Inc., Reducing Off-Axis Comb Filter Effects in Highly Directional Microphones, Presented at the 81st Convention Nov. 12-16, 1986, Los Angeles, CA, 2405 (D-19), pp. 1-9.

Olson, Harry F., Directional Microphones, Journal of the Audio Engineering Society, pp. 420-430. Oct. 1967.

B. Kollmeier, et al. Binaural Noise-Reduction Hearing Aid Scheme with Real-Time Processing in the Frequency Domain, Scand Audiol 1993; Suppl. 38; 28-38.

International Preliminary Report on Patentability dated Sep. 16, 2009 for PCT/US08/064056.

Bai, et al. Micrphone array signal processing with application in three-dimensional spatial hearing, J. Acoust. Soc. Am. 117 (4), Pt. 1, Apr. 2005 0001-4966/2005/117(4)/2112/10/$22.50 a2005 Acoustical Society of America, pp. 2112-2121.

Fortschritt-BerichteVDI, Dipl. Phys. Jurgen Peissign, Gottingen, Binaurale Horgeratestrategien in komplexen Storschallsituationen, Reihe 17: Biotechnik, a 1993.

International Search Report and Written Opinion dated Jun. 23, 2009 issued in International Application No. PCT/US2009/037503.

Canetto, B., et al: "Speech Enhancement Systems Based on Microphone Arrays", 20020527; 20020527-20020531, May 27, 2002, pp. 1-9, XP007905367.

ISR/WO dated Aug. 12, 2008 for PCT/US08/064056.

B. Kollmeier, et al. Binaural Noise-Reduction Hearing Aid Scheme with Real-Time Processing in the Frequency Domain, Scand Audiol 1993; Suppl. 38: 28-38. From the Drittes Physikalisches Institut der Unviersitut Gottingen, Burgerstr. 42-44, W-3400 Gottingen, FR Germany.

P. Bloom, Evaluation of Two-Input Speech Dereverberation Techniques, Division of Engineering Polytechnic of Central London, London WIM 8JS, England. CH 1746-7/82/0000—0164 $00.75 © 1982 IEEE, pp. 164-167.

Baard, Frames with baked-in hearing aides, Apr. 17, 2006, http://www.boston.com/business/personaltech/articles/2006/04/17/frames_with_baked_in_hearing_ai. . . , Downloaded Apr. 19, 2006.

Aarabi, Post Recognition Speech Localization, International Journal of Speech Technology 8, 173-180, 2005, Springer Science + Business Media, Inc. Manufactured in The Netherlands, pp. 173-180.

V. Hamacher, et al., Signal Processing in High-End Hearing Aids: State of the Art, Challenges, and Future Trends, EURASIP Journal on Applied Signal Processing 2005:18, 2915-2929 © 2005 V. Hamacher et al.

Aarabi, MIT's Magazine of Innovation Technology Review, Oct. 2005, USDA, www.technologyreview.com, p. 42.

First Office Action for CN Application No. 200880020920.2, dated May 28, 2012.

JP Office Action dated Jun. 25, 2013 for JP2012-073301.

EP Refusal Decision dated Jul. 22, 2013 for EP09733837.0.

Beranek, Leo L.; "Acoustics", Published for the Acoustical Society of America by the American Institue of Physics; 1954, 1986.

Japanese Office Action dated Jan. 8, 2013 for Application No. 2011-506317.

Chinese Office Action dated Jan. 24, 2013 for Application No. 200980113532.3.

Chinese Office Action dated Jul. 31, 2013 for Application No. 200980113532.3.

* cited by examiner

SOUND DISCRIMINATION METHOD AND APPARATUS

FIELD

The invention, relates generally so the field of acoustics, and in particular to sound pick-up and reproduction. More specifically, the invention relates to a sound discrimination method and apparatus.

BACKGROUND

In a typical live music concert, multiple microphones (acoustic pick-up devices) are positioned close to each of the instruments and vocalists. The electrical signals from the microphones are mixed, amplified, and reproduced by loudspeakers so that the musicians can clearly foe heard by the audience in a large performance space.

A problem with conventional microphones is that they respond not only to the desired instrument or voice, but also to other nearby instruments and/or voices. If, for example, the sound of the drum kit bleeds into the microphone of the lead singer, the reproduced sound is adversely effected. This problem also occurs when musicians are in a studio recording their music.

Conventional microphones also respond to the monitor loudspeakers used by the musicians onstage, and to the house loudspeakers that distribute the amplified sound to the audience. As a result, gains must foe carefully monitored to avoid feedback, in which the music ample lying system breaks out in howling that spoils a performance. This is especially problematic in live amplified performances, since the amount of signal from, the loudspeaker picked up by the microphone can vary wildly, depending on how musicians move about on stage, or how they move the microphones as they perform. An amplification system that has been carefully adjusted to be free from feedback during rehearsal may suddenly break out in howling during the performance simply because a musician has moved on stage.

One type of acoustic pick-up device is an omni directional microphone. An omni directional microphone is rarely used for live music because it tends to be more prone to feedback. More typically, conventional microphones having a directional acceptance pattern (e.g., a cardioid microphone) are used to reject off axis sounds output from other instruments or voices, or from speakers, thus reducing the tendency for the system to howl. However, these microphones have insufficient rejection to fully solve the problem.

Directional microphones generally have a frequency response that varies with the distance from the source. This is typical of pressure gradient responding microphones. This effect is called the "proximity effect", and it results in a bass boost when the microphone is close to the source and a loss of bass when the microphone is far from the source. Performers who like proximity effect often vary the distance between the microphone and the instrument (or voice) during a performance to create effects and to change the level of the amplified sound. This process is called "working the mike".

While some performers like proximity effect, other performers prefer that over the range of angles and distances that the microphone accepts sounds, the frequency response of the improved sound reproducing system should remain as uniform as possible. For these performers the timbre of the instrument should not change as the musician moves closer to or further from the microphone.

Cell phones, regular phones and speaker phones can have performance problems when there is a lot of background noise. In this situation the clarity of the desired speakers voice is degraded or overwhelmed by this noise. It would be desirable for these phones to be able to discriminate between the desired speaker and the background noise. The phone would then provide a relative emphasis of the speaker's voice over the noise.

SUMMARY

The present invention is directed to overcoming one or more of the problems set forth above. Briefly summarized, according to one aspect of the present invention, method of distinguishing sound sources includes transforming data, collected by at least two transducers which each react to a characteristic of an acoustic wave, into signals for each transducer location. The transducers are separated by a distance of less than about 70 mm or greater than about 90 mm. The signals are separated into a plurality of frequency bands for each transducer location. For each band a relationship of the magnitudes of the signals for the transducer locations is compared with a first threshold value. A relative gain change is caused between those frequency bands whose magnitude relationship falls on one side of the threshold value and those frequency bands whose magnitude relationship falls on the other side of the threshold value. As such, sound sources are discriminated from each other based on their distance from the transducers.

Further features of the invention include (a) using a fast Fourier transform to convert the signals from a time domain to a frequency domain, (b) comparing a magnitude of a ratio of the signals, (c) causing those frequency bands whose magnitude comparison falls on one side of the threshold value to receive a gain of about 1, (d) causing those frequency bands whose magnitude comparison falls on the other side of the threshold value to receive a gain of about 0, (e) that each transducer is an omni-directional microphone, (f) converting the frequency bands into output signals, (g) using the output signals to drive one or more acoustic drivers to produce sound, (h) providing a user-variable threshold value such that a user can adjust a distance sensitivity from the transducers, or (i) that the characteristic is a local sound pressure, its first-order gradient, higher-order gradients, and/or combinations thereof.

Another feature involves providing a second threshold value different from the first threshold value. The causing step causes a relative gain change between those frequency bands whose magnitude comparison falls in a first range between the threshold values and those frequency bands whose magnitude comparison falls outside the threshold values.

A still further feature involves providing third and fourth threshold values that define a second range that is different from and does not overlap the first range. The causing step causes a relative gain change between those frequency bands whose magnitude comparison falls in the first or second ranges and those frequency bands whose magnitude comparison falls outside the first and second ranges.

Additional features call for (a) the transducers to be separated by a distance of no less than about 250 microns, (b) the transducers to be separated by a distance of between about 20 mm to about 50 mm, (c) the transducers to be separated by a distance of between about 25 mm to about 45 mm (d) the transducers to be separated by a distance of about 35 mm, and/or (e) the distance between the transducers to be measured from a center of a diaphragm for each transducer.

Other features include that (a) the causing step fades the relative gain change between a low gain and a high gain, (b) the fade of the relative gain change is done across the first threshold value, (c) the fade of the relative gain change is done across a certain magnitude level for an output signal of one or more of the transducers, and/or (d) the causing of a relative gain change is effected by (1) a gain term based on the magnitude relationship and (2) a gain term based on a magnitude of an output signal from one or more of the transducers.

Still further features include that (a) a group of gain terms derived for a first group of frequency bands is also applied to a second group of frequency bands, (b) the frequency bands of the first group are lower than the frequency bands of the second group, (c) the group of gain terms derived for the first group of frequency bands is also applied to a third group of frequency bands, and/or (d) the frequency bands of the first group are lover than the frequency bands of the third group.

Additional features call for (a) the acoustic wave to be traveling in a compressible fluid, (b) the compressible fluid to be air, (c) the acoustic wave to be traveling in a substantially incompressible fluid (d) the substantially incompressible fluid to be water, (e) the causing step to cause a relative gain change to the signals from only one of the two transducers, (f) a particular frequency band to have a limit in how quickly a gain for that frequency band can change, and/or (g) there to be a first limit for how quickly the gain can increase and a second limit for how quickly the gain can decrease, the first limit and second limit being different.

According to another aspect, a method of discriminating between sound sources includes transforming data, collected by transducers which react to a characteristic of an acoustic wave, into signals for each transducer location. The signals are separated into a plurality of frequency bands for each location. For each band a relationship of the magnitudes of the signals for the locations is determined. For each band a time delay is determined from the signals between when an acoustic wave is detected by a first transducer and when this wave is defected by a second transducer. A relative gain change is caused between those frequency bands whose magnitude relationship and time delay fall on one side of respective threshold values for magnitude relationship and time delay, and those frequency bands whose (a) magnitude relationship falls on the other side of its threshold value, (b) time delay falls on the other side of its threshold value, or (c) magnitude relationship and time delay both fall on the other side of their respective threshold values.

Further features include (a) providing an adjustable threshold value for the magnitude relationship, (b) providing an adjustable threshold value for the time delay, (c) fading the relative gain change across the magnitude relationship threshold, (d) fading the relative gain change across the time delay threshold, (e) that causing of a relative gain change is effected by (1) a gain term based on the magnitude relationship and (2) a gain term based on the time delay, if) that the causing of a relative gain change is further effected by a gain term based on a magnitude of an output signal from one or more of the transducers, and/or (g) that for each frequency band there is an assigned threshold value for magnitude relationship and an assigned threshold value for time delay.

A still further aspect involves a method of distinguishing sound sources. Data collected by at least three omni-directional microphones which each react to a characteristic of an acoustic wave is captured. The data is processed to determine (1) which data represents one or more sound sources located less than a certain distance from the microphones, and (2) which data represents one or more sound sources located more than the certain distance from the microphones. The results of the processing step are utilized to provide a greater emphasis of data representing the sound source (s) in one of (1) or (2) above over data representing the sound source(s) in the other of (1) or (2) above. As such, sound sources are discriminated from each other based on their distance from the microphones.

Additional features include that (a) the utilizing step provides a greater emphasis of data representing the sound source(s) in (1) over data representing the sound source(s) in (2), (b) after the utilizing step the data is converted into output signals, (c) a first microphone is a first distance from a second microphone and a second distance from a third microphone, the first distance being less than the second distance, (d) the processing step selects high frequencies from the second microphone and low frequencies from the third microphone which are lower than the high frequencies, (e) the low frequencies and high, frequencies are combined in the processing step, and/or (f) the processing step determines (1) a phase relationship from the data from microphones one and two, and (2) determines a magnitude relationship from the data from microphones one and three.

According to another aspect, a personal communication device includes two transducers which react to a characteristic of an acoustic wave to capture data representative of the characteristic. The transducers are separated by a distance of about 70 mm or less. A signal processor for processing the data determines (1) which data represents one or more sound sources located loss than a certain distance from the transducers, and (2) which data represents one or more sound sources located more than the certain distance from, the transducers. The signal processor provides a greater emphasis of data representing the sound source(s) in one of (1) or (2) above over data, representing the sound source(s) in the other of (1) or (2) above. As such, sound sources are discriminated from each other based on their distance from the transducers.

Further features call for (a) the signal processor to convert the data into output signals, (b) the output signals to be used, to drive a second acoustic driver remote from cue device to produce sound remote from the device, (c) she transducers to be separated by a distance of no less than about 250 microns, (d) the device to be a cell phone, and/or (e) the device to be a speaker phone.

A still further aspect, calls for a microphone system having a silicon chip and two transducers secured to the chip which react to a characteristic of an acoustic wave to capture data representative of the characteristic. The transducers are separated by a distance of about 70 mm or less. A signal processor is secured to the chip for processing the data to determine (1) which data represents one or more sound sources located less than a certain distance from the transducers, and (2) which data represents one or more sound sources located more than the certain distance from the transducers. The signal processor provides a greater emphasis of data representing the sound source(s) in one of (1) or (2) above over data representing the sound source(s) in the other of (1) or (2) above, such that sound sources are discriminated from each other based on their distance from the transducers.

Another aspect calls for a method of discriminating between sound sources. Data collected by transducers which react to a characteristic of an acoustic wave is transformed into signals for each transducer location. The signals are separated into a plurality of frequency bands for each location. A relationship of the magnitudes of the signals is determined for each band for the locations. For each band a phase shift is determined from the signals which is indicative of when an acoustic wave is detected by a first transducer and when this wave is detected by a second transducer. A relative gain change is caused between those frequency bands whose magnitude relationship and phase shift fall on one side of respective threshold values for magnitude relationship and phase shift, and those frequency bands whose (1) magnitude relationship falls on the other side of its threshold value, (2) phase shift falls on the other side of its threshold value, or (3) magnitude relationship and phase shift both fall on she other side of their respective threshold values.

An additional feature calls for providing an adjustable threshold value for the phase shift.

According to a further aspect, a method of discriminating between sound sources includes transforming data, collected by transducers which react to a characteristic of an acoustic wave, into signals for each transducer location. The signals are separated into a plurality of frequency bands for each location. For each band a relationship of the magnitudes of the signals is determined for the locations. A relative gain change is caused between those frequency bands whose magnitude relationship falls on one sloe of a threshold value, and those frequency bands whose magnitude relationship falls on the other side of the threshold value. The gain change is faded across the threshold value to avoid abrupt gain changes at or near the threshold.

Another feature calls determining from the signals a time delay for each band between when an acoustic wave is detected by a first transducer and when this wave is detected by a second transducer. A relative gain change is caused between those frequency bands whose magnitude relationship and time delay fall on one side of respective threshold values for magnitude relationship and time delay, and those frequency bands whose (1) magnitude relationship falls on the other side of its threshold value, (2) time delay falls on the other side of its threshold value, or (3) magnitude relationship and time delay both fall on the other side of their respective threshold values. The gain change is faded across the threshold value to avoid abrupt gain changes at or near the threshold.

Other features include that (a) a group of gain terms derived for a first octave is also applied to a second octave, (b) the first octave is lower than the second octave, (c) the group of gain terms derived for the first octave is also applied, to a third octave, (d) the frequency bands of the first octave is lower than the third octave, and/or (e) the frequency bands of the first group are lower than, the frequency bands of the second, group.

Another aspect involves a method of discriminating between sound sources. Data, collected by transducers which react to a characteristic of an acoustic wave, is transformed into signals for each transducer location. The signals are separated into a plurality of frequency bands for each location. Characteristics of the signals are determined for each band which are indicative of a distance and angle to the transducers of a sound source providing energy to a particular band. A relative gain change is caused between those frequency bands whose signal characteristics indicate that a sound source providing energy to a particular band meets distance and angle requirements, and those frequency bands whose signal characteristics indicate that a sound source providing energy to a particular band (a) does not meet a distance requirement, (b) does not meet an angle requirement, or (c) does not meet distance and angle requirements.

Further features include that the characteristics include (a) a phase shift which is indicative of when an acoustic wave is detected by a first transducer and when this wave is detected by a second transducer, and/or (b) a time delay between when an acoustic wave is detected by a first transducer and when this wave is detected by a second transducer, whereby an angle to the transducers of a sound source providing energy to a particular band, is indicated.

An additional feature calls for the output signals to be (a) recorded on a storage medium, (b) communicated by a transmitter, and/or (c) further processed and used to present information on location of sound sources.

A further aspect of the invention calls for a method of distinguishing sound sources. Data collected by four transducers which each react to a characteristic of an acoustic wave is transformed into signals for each transducer location. The signals are separated into a plurality of frequency bands for each transducer location. For each band a relationship of the magnitudes of the signals for at feast two different pairs of the transducers is compared with a threshold value. A determination is made for each transducer pair whether the magnitude relationship falls on one side or the other side of the threshold value. The results of each determination is utilized to decide whether an overall magnitude relationship falls on one side or the other side of the threshold value. A relative gain change is caused between those frequency bands whose overall magnitude relationship falls on one side of the threshold value and those frequency bands whose overall magnitude relationship falls on the other side of the threshold value, such that sound sources are discriminated from each other based on their distance from, the transducers.

Other features call for (a) the four transducers to be arranged in a linear array, (b) a distance between each adjacent pair of transducers to be substantially the same, (c) each of the four transducers to be located at respective vertices of an imaginary polygon, and/or (d) giving a weight to results of the determination for each transducer pair.

Another aspect calls for a method of distinguishing sound sources. A sound distinguishing system is switched, to a training mode. A sound source is moved to a plurality of locations within a sound source accept region such that the sound distinguishing system can determine a plurality of thresholds for a plurality of frequency bins. The sound distinguishing system, is switched to an operating mode. The sound distinguishing system uses the thresholds to provide a relative emphasis to sound sources located in the sound source accept region over sound sources located outside the sound source accept region.

Another feature calls requires that two of the microphones be connected by an imaginary straight line that extends in either direction to infinity. The third microphone is located away from this line.

One more feature calls for comparing a relationship of the magnitudes of the signals for six unique pairs of the transducers with a threshold value.

These and other aspects, objects, features and advantages of the present invention will be more clearly understood and appreciated from a review of the following detailed description and appended claims, and by reference to the accompanying drawings.

BRIEF DESCRIPTION OF THE DRAWINGS

FIG. 11 is a schematic diagram of a third embodiment of a microphone system;

FIG. 16B is a schematic diagram of another portion of the fourth embodiment;

DETAILED DESCRIPTION OF THE EMBODIMENTS

For some sound applications (e.g. the amplification of live music, sound recording, cell phones and speaker phones), a microphone system with an unusual set of directional properties is desired. A new microphone system having these properties is disclosed that, avoids many of the typical problems of directional microphones while offering improved performance. This new microphone system uses the pressures measured by two or more spaced microphone elements (transducers) to cause a relative positive gain for the signals from sound sources that fall within a certain acceptance window of distance and angle relative to the microphone system compared to the gain for the signals from all other sound sources.

These goals are achieved with a microphone system having a very different directional pattern than conventional microphones. A new microphone system with this pattern accepts sounds only within an "acceptance window". Sounds originating within a certain distance and angle from the microphone system are accepted. Sounds originating outside this distance and/or angle are rejected.

In one application of the new microphone system (a live music performance), sources we'd like to reject, such as the drum kit at the singer's microphone, or the loudspeakers at any microphone, are likely to be too far away and/or at the wrong angle to be accepted by the new microphone system. Accordingly, the problems described above are avoided.

Figure 1:
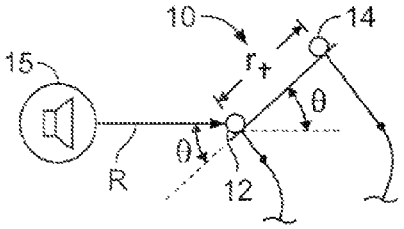
FIG. 1 is a schematic diagram of a sound source in a first position relative to an acoustic pick-up device.

Beginning with FIG. 1, an acoustic pick-up device 10 includes front and rear transducers 12 and 14. The transducers collect data at their respective locations by reacting to a characteristic of an acoustic wave such as local sound pressure, the first order sound pressure gradient, higher-order sound pressure gradients, or combinations thereof. Each transducer in this embodiment can be a conventional, omni-directional sound pressure responding microphone, and the transducers are arranged in a linear array. The transducers each transform the instantaneous sound pressure present at their respective location into electrical signals which represent the sound pressure over time at those locations.

Consider the ideal situation of a point source of sound 15 in free space, shown as a speaker in FIG. 1. Sound source 15 could also be, for example, a singer or the output of a musical instrument. The distance from sound source 15 to front transducer 12 is R, and the angle between the acoustic pick-up device 10 and the source is θ. Transducers 12, 14 are separated by a distance $r_t$. From the electrical signals discussed above, knowing $r_t$, and comparing aspects of the signals with thresholds, it can be determined whether or not to accept sounds from sound source 15. The time difference between when a sound pressure wave reaches transducer 12 and when the wave reaches transducer 14 is τ. The symbol c is the speed of sound. Accordingly, a first equation which includes the unknown θ is as follows:

$$\theta = \operatorname{acos}\left[\frac{1}{2}\cdot\frac{[-(r_t)^2]+\tau^2\cdot c^2-2\cdot\tau\cdot c\cdot R}{r_t\cdot R}\right]$$

Also, We can measure the sound pressure magnitude M1 and M2 at the respective locations of transducers 12 and 14, and we know $r_t$. As such, we can set up a second equation including unknown R as:

$$R=\frac{1}{2}\cdot\frac{\frac{M1}{M2}}{\left(\frac{M1}{M2}\right)^2-1}\cdot\left[(-2)\cdot\frac{M1}{M2}\cdot\cos(\theta)+2\cdot\left[\left(\frac{M1}{M2}\right)^2\cdot\cos(\theta)^2-\left(\frac{M1}{M2}\right)^2+1\right]^{\frac{1}{2}}\right]\cdot r_t$$

Thus, we have two equations and two unknowns R and θ (given $r_t$, τ, c and M1/M2). The two equations are numerically solved simultaneously using a computer.

Figure 2:
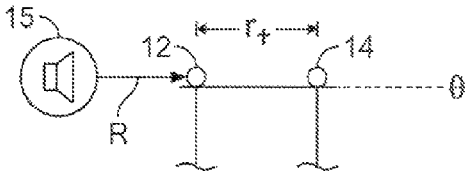
FIG. 2 is a schematic diagram of the sound source in a second position relative to the acoustic pick-up device.

An example is provided in FIG. 2. In this example it is assumed that sound source 15 emits spherical waves. When R is small compared to a distance $r_t$ between transducers 12, 14, and θ=0°, there will be a large sound pressure magnitude difference between the two transducer signals. This occurs because there is a large relative difference between distance R from sound source 15 to transducer 12 and the distance R+$r_t$ from source 15 to transducer 14. For a point source of sound the sound pressure magnitude drops as a function of 1/R from source 15 to transducer 12 and 1/(R+$r_t$) from source 15 to transducer 14.

The distance $r_t$ is preferably measured from the center of a diaphragm for each of transducers 12 and 14. Distance $r_t$ is preferably smaller than a wavelength for the highest frequency of interest. However, $r_t$ should not be too small as the magnitude ratios as a function of distance will, be small and thus more difficult to measure. Where the acoustic waves are traveling in a gas where c approx.=343 m/s (e.g. air), distance $r_t$ in one example is preferably about 70 millimeters (mm) or less. At about 70 mm the system is boss suited for acoustic environments consisting primarily of human, speech and similar signals. Preferably distance $r_t$ is between about 20 mm to about 50 mm. More preferably distance $r_t$ is between about 25 mm to about 45 mm. Most preferably distance $r_t$ is about 35 mm.

To this point the description has been inherently done in an environment of a compressible fluid (e.g. air). It should be noted that this invention will also be effective in an environment of an incompressible fluid (e.g. water or salt water). In the case of water the transducer spacing can be about 90 mm or greater. If it is only desired to measure low or extremely low frequencies, the transducer spacing can get quite large. For example, assuming the speed of sound in water is 1500 meters/second and the highest frequency of interest is 100 hz, then the transducers can be spaced 15 meters apart.

Figure 3:
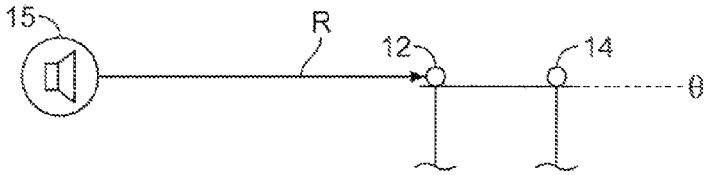
FIG. 3 is a schematic diagram of the sound source in a third position relative to the acoustic pick-up device.

Turning to FIG. 3, when R is relatively large and θ=0% the relative time difference (delay) remains the same, but the difference in magnitude between the signals of transducers 12, 14 decreases significantly. As R becomes very large, the magnitude difference approaches zero.

Figure 4:
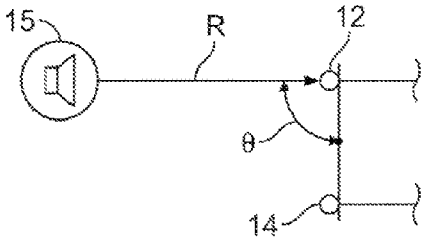
FIG. 4 is a schematic diagram of the sound source in a fourth position relative to the acoustic pick-up device.

Referring to FIG. 4, For any R, when θ=90°, the time delay between transducers 12 and 11 vanishes, since the path length from, sound source 15 to each transducer 12, 14 is the same. At angles between 0° and 90°, the time delay decreases from $r_t/c$ to zero. Generally speaking, the magnitudes of the signals of transducers 12, 14 when θ=90° will be equal. It can be seen that there is variation in the relative magnitude, relative phase (or time delay), or both in the signals output from the transducer pair of FIGS. 2-4 as a function of the location of the sound source 15 with respect to the location of audio device 10. This is shown more completely in FIGS. 6 *a-c*, described in more detail below. The sound source angle can be calculated at any angle. However, in this example, the sound source distance R becomes progressively more difficult to estimate as θ approaches ±90°, This is because at ±90° there is no longer any magnitude difference between M1 and M2 regardless of distance.

Figure 5:
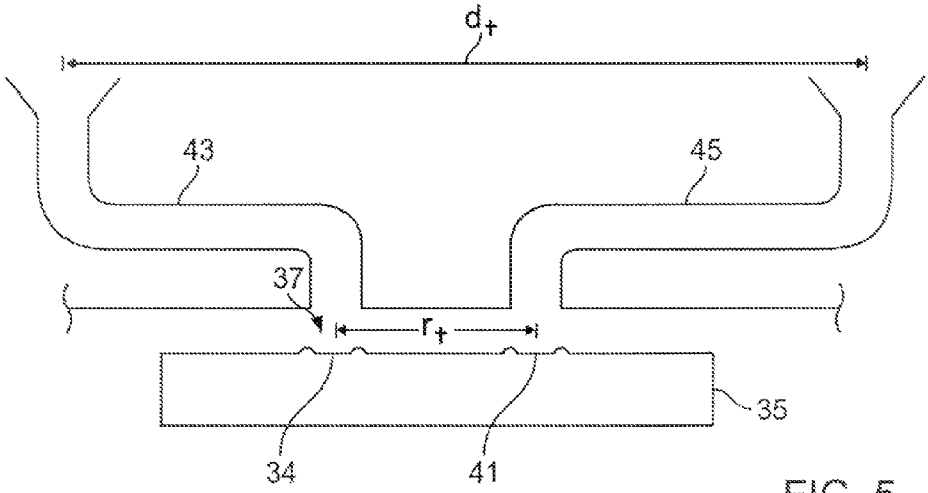
FIG. 5 is a cross-section of a silicon, chip with a microphone array.

With reference to FIG. 5, a cross-section of a silicon chip 35 discloses a Micro-Electro-Mechanical Systems (MEMS) microphone array 37. Array 37 includes a pair of acoustic transducers 34, 41 which are spaced a distance $r_t$ of at least about 250 microns from each other. Optional ports 43, 45 increase an effective distance $d_t$ at which transducers 34, 41 "hear" their environment. Distance $d_t$ can be set at any desired length up to about 70 mm. Chip 35 also includes the associated signal processing apparatus (not shown in FIG. 5) which are connected to transducers 34, 41. An advantage of a MEMS microphone array is that, some or all of desired signal processing (discussed below), for example: signal conditioning, A/D conversion, windowing, transformation, and D/A conversion, etc., can be placed on the same chip. This provides a very compact, unitary microphone system. An example of a MEMS microphone array is the AKU2001 Tri-State Digital Output CMOS MEMS Microphone available from Akustica, Inc. 2335 East Carson Street, Suite 301, Pittsburgh, Pa. 15203 (http://www.akustica.com/documents/AKU2001ProductBrief.pdf).

Figure 6A:
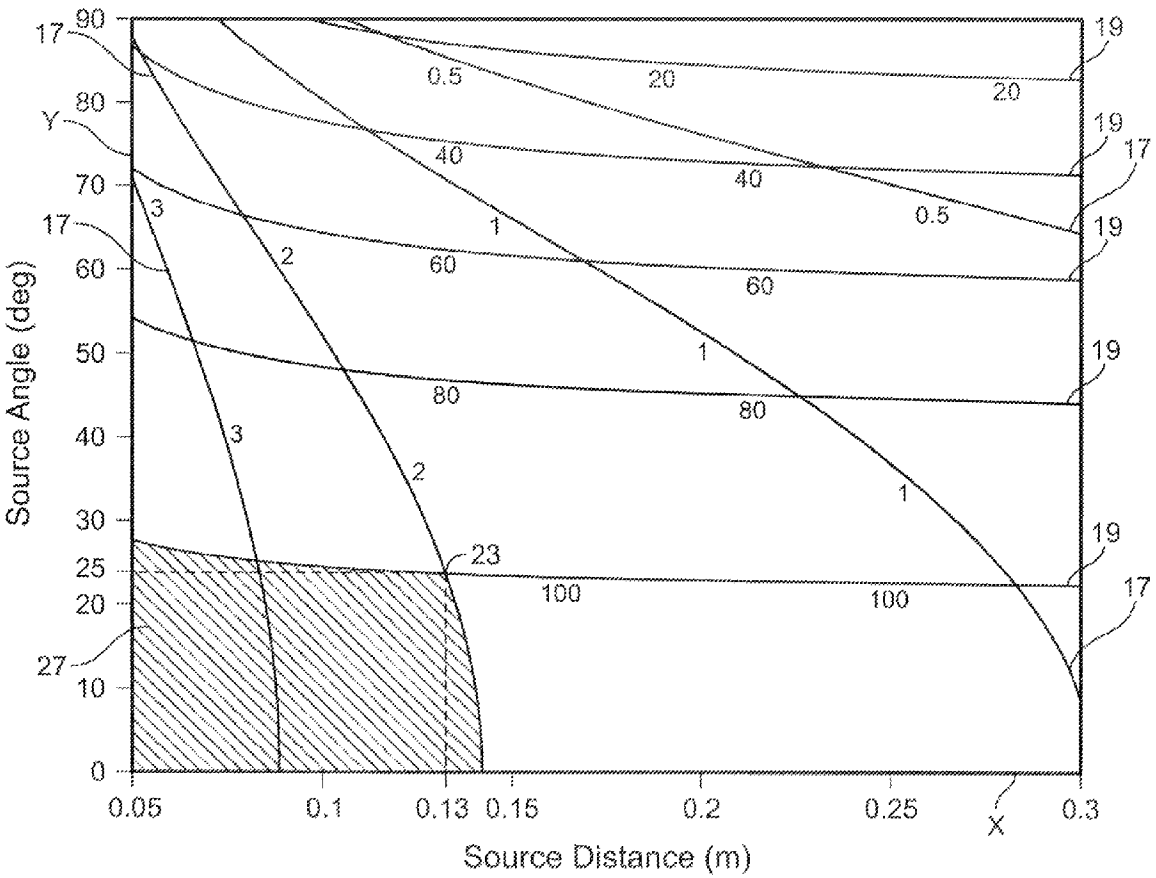
FIG. 6A-C show plots of lines of constant dB difference and time difference as a function of angle and distance.

Turning to FIG. 6*a*, a theoretical plot is provided of magnitude difference and time delay difference (phase) of the signals present at the location of transducers 12, 14 due to sound output by sound 15, as a function of source 15's location (angle and distance) relative to the location of audio device 10 (consisting of transducers 12 and 14). The plot of FIGS. 6*a-c* was calculated assuming the distance $r_t$ between transducers 12, 14 is 35 mm. The equations in paragraph 39 above were used to computationally create this plot. Here, however R and 8 are set to known values and τ and M1/M2 are calculated. The theoretical sound source angle θ and distance R are varied over a wide range to determine a range of τ and M1/M2, A Y axis provides the sound source angle θ in degrees and an X axis provides the sound source distance in meters. Lines 17 of constant magnitude difference in dB are plotted. Lines 19 of constant time difference (microseconds) of the signals at the location of transducers 12, 14 are also plotted. More gradations can be provided if desired.

If, for example, it is desired to only accept sound sources located less than 0.13 meters from transducer 12 and at an angle θ of less than 25 degrees, we find the intersection of these values at a point 23. At point 23 we see that the magnitude difference must be greater than 2 dB and time delay must be greater than 100 microseconds. A hatched area 27 indicates the acceptance window for this setting. If the sound source causes a magnitude difference of greater than or equal to 2 dB and a time delay of greater than or equal to 100 microseconds, then we accept that sound source. If the sound source causes a magnitude difference of less than 2 dB and/or a time delay of less than 100 microseconds, then we reject that sound source.

The above type of processing and resulting accepting or rejecting a sound source based on its distance and angle from the transducers, is done on a frequency band by frequency band basis. Relatively narrow frequency bands are desirable to avoid blocking desired sounds or passing non desired sounds. It is preferable to use narrow frequency bands and short time blocks, although those two characteristics conflict with each other. Narrower frequency bands enhance the rejection of unwanted acoustic sources but require longer time blocks. However, longer time blocks create system latency that can be unacceptable to a microphone user. Once a maximum acceptable system latency is determined, the frequency band width can be chosen. Then the block time is selected. Further details are provided below.

Because the system works independently over many frequency bands, a desired singer, located on-axis 0.13 meters from the microphone singing a C is accented, while a guitar located off-axis 0.25 meters from the microphone playing an E is rejected. Thus, if a desired singer less than 0.13 meters and on axis from the microphone is singing a C, but a guitar is playing an E 0.25 meters from the microphone at any angle, the microphone system passes the vocalist's C and its harmonics, while simultaneously rejecting the instrumentalist's E and its harmonics.

Figure 6B:
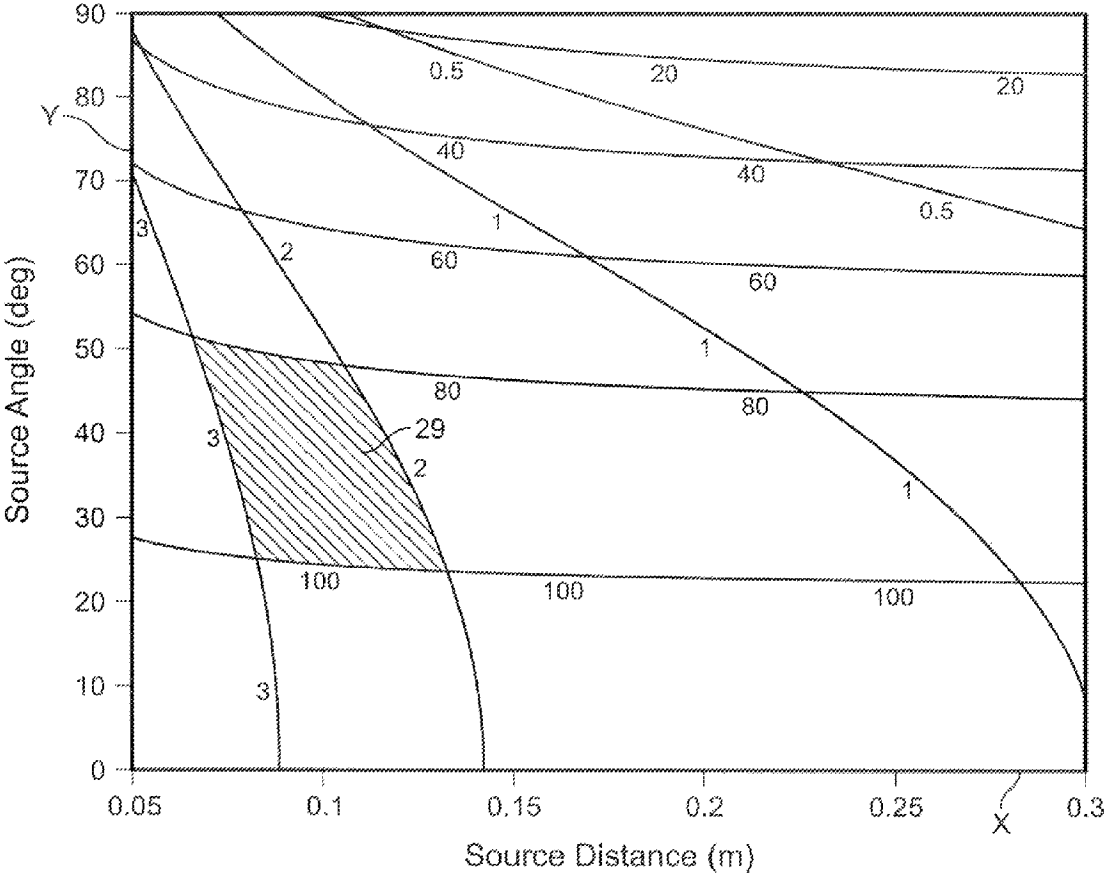

FIG. 6B shows an embodiment where two thresholds are used for each of magnitude difference and time difference. Sound sources that cause a magnitude difference of 2≤db differences ≤3 and a time difference 80≤micro seconds≤100 are accepted. The acceptance window is identified by the hatched area 29. Sound sources that cause a magnitude difference and/or a time difference outside of acceptance window 29 are rejected.

Figure 6C:
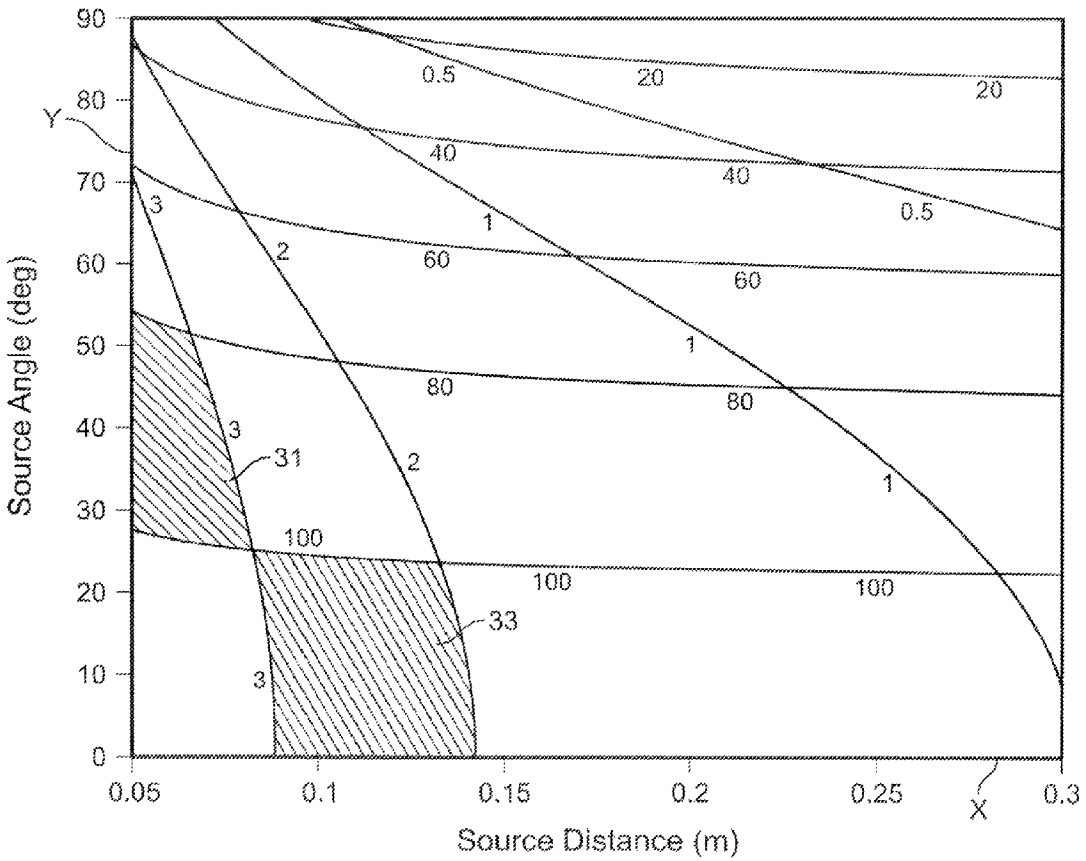

FIG. 6C shows an embodiment where two acceptance windows 31 and 33 are used. Sound sources that cause a magnitude difference of ≥3 dB and a time difference 80≤micro seconds≤100 are accepted. Sound sources that cause a magnitude difference of 2≤dB differences ≤3 and a time difference ≥100 microseconds are also accepted. Sound sources that cause a magnitude difference and/or a time difference outside or acceptance windows 31 and 33 are rejected. Any number of acceptance windows can be created by using appropriate thresholds for magnitude difference and time difference.

Figure 7:
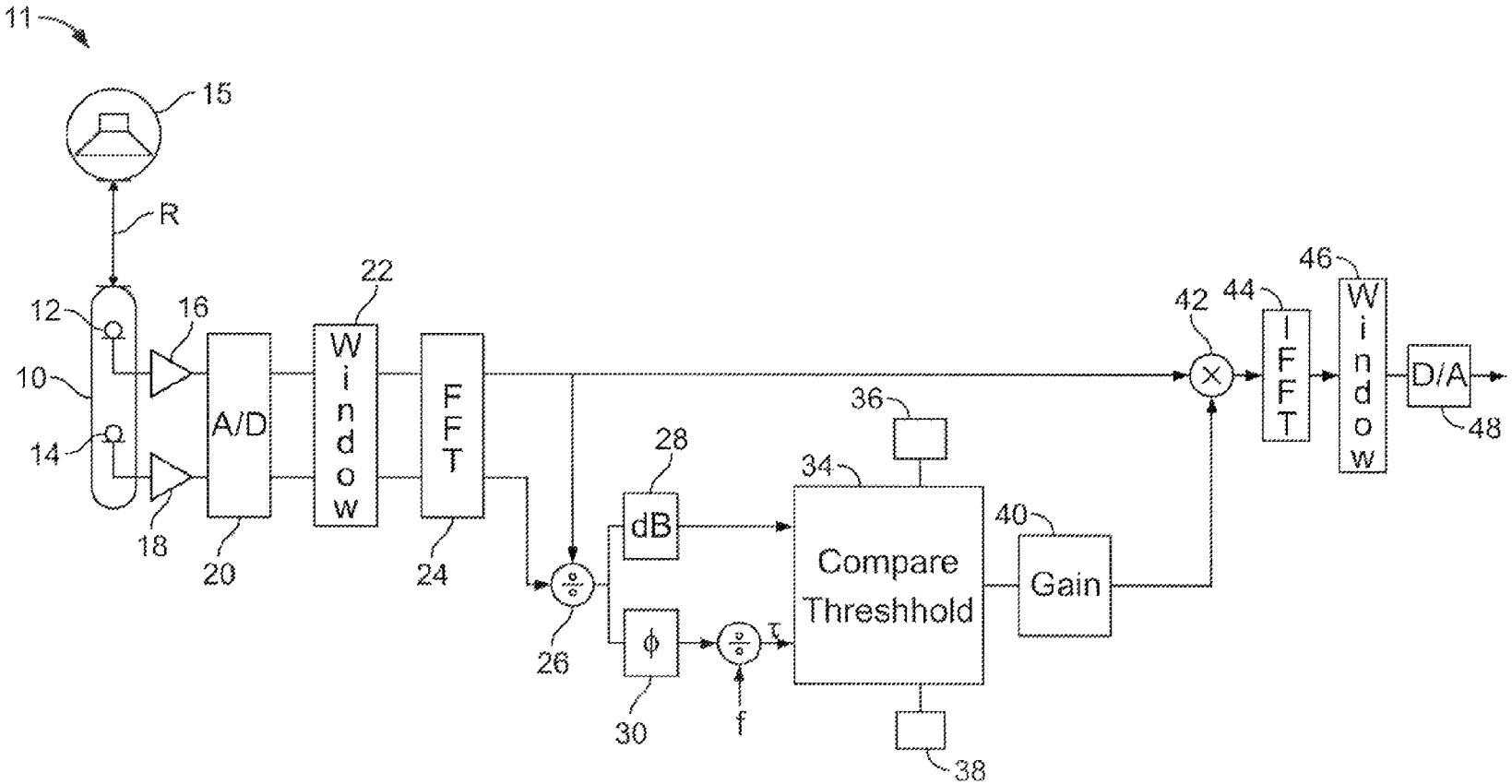
FIG. 7 is a schematic diagram of a first embodiment of a microphone system.

Turning now to FIG. 7, a microphone system 11 will be described. An acoustic wave from sound source 15 causes transducers 12, 14 to produce electrical signals representing characteristics of the acoustic wave as a function of time. Transducers 12, 14 are each preferably an omni-directional microphone element which can connect to other parts of the system via a wire or wirelessly. The transducers in this embodiment have the center of their respective diaphragms separated by a distance of about 35 mm. Some or all of the remaining elements in FIG. 7 can be incorporated into the microphone, or they can be in one or more separate components. The signals for each transducer pass through respective conventional pre-amplifiers 16 and 18 and a conventional analog-to-digital A/D; converter 20. In some embodiments, a separate A/D converter is used to convert the signal output by each transducer. Alternatively, a multiplexer can be used with a single A/D converter. Amplifiers 16 and 13 can also provide PC power (i.e. phantom power) to respective transducers 12 and 14 if needed.

Using block processing techniques which are well known to those skilled in the art, blocks of overlapping data are windowed at a block 22 (a separate windowing is done on the signal fox each transducer). The windowed data are transformed from the time domain into the frequency domain using a fast Fourier transform (FFT) at a block 24 (a separate FFT is done on the signal for each transducer). This separates the signals into a plurality of linear spaced frequency bands (i.e. bins) for each transducer location. Other types of transforms can be used to transform the windowed data from the time domain to the frequency domain. For example, a wavelet transform may be used instead of an FFT to obtain log spaced frequency bins. In this embodiment a sampling frequency of 32000 samples/sec is used with each block containing 512 samples.

The definition of the discrete Fourier transform (DFT) in its inverse is as follows:

The functions X=fft(x) and x=ifft(x) implement the transform and inverse transform pair given for vectors, of length N by;

$$X(k) = \sum_{j=1}^{N} x(j)\omega_N^{(j-1)(k-1)}$$

$$x(j) = (1/N)\sum_{k=1}^{N} X(k)\omega_N^{-(j-1)(k-1)}$$

where $$\omega_N = e^{(-2\pi i)/N}$$

is an Nth root of unity.

The FFT is an algorithm for implementing the DFT that speeds the computation. The Fourier transform of a real signal (such as audio) yields a complex result. The magnitude of a complex number X is defined as:

$$\text{sqrt}(\text{real}(X)\cdot\hat{}2+\text{imag}(X)\cdot\hat{}2)$$

The angle of a complex number X is defined as;

$$\arctan\left(\frac{\text{Im}(X)}{\text{Re}(X)}\right)$$

where the sign of the real and imaginary parts is observed to place the angle in the proper quadrant of the unit circle, allowing a result in the range:

$$-\pi \leq \text{angle}(X) < \pi$$

The equivalent time delay is defined as:

$$\frac{\text{angle}(X)}{2\cdot\pi\cdot f}$$

The magnitude ratio of two complex values, X1 and X2 can be calculated in any of a number of ways. One can take the ratio of X1 and X2, and then find the magnitude of the result. Or, one can find the magnitude of X1 and X2 separately, and take their ratio. Alternatively, one can work in log space, and take the log of the magnitude of the ratio, or alternatively, the difference (subtraction) of log (X1) and log(X2).

Similarly, the time delay between two complex values can be calculated in a number of ways. One can take the ratio of X1 and X2, find the angle of the result and divide by the angular frequency. One can find the angle of X1 and X2 separately, subtract them, and divide the result by the angular frequency.

As described above, a relationship of the signals is established. In some embodiments the relationship is the ratio of the signal from front transducer 12 to the signal from rear transducer 14 which is calculated for each frequency bin on a block-by-block basis at a divider block 26. The magnitude of this ratio (relationship; in dB is calculated at a block 28. A time difference (delay) T (Tau) is calculated for each frequency bin on a block-by-block basis by first computing the phase at a block 30 and then dividing the phase by the center frequency of each frequency bin at a divider 32. The time delay represents the lapsed time between when an acoustic wave is detected by transducer 12 and when this wave is detected by a transducer 14.

Other well known digital signal processing (DSP) techniques for estimating magnitude and time delay differences between the two transducer signals may be used. For example, an alternate approach to calculating time delay differences is to use cross correlation in each frequency band between the two signals X1 and X2.

The calculated magnitude relationship and time differences (delay) for each frequency bin (band) are compared with threshold values at a block 34. For example, as described above in FIG. 6A, if the magnitude difference is greater than or equal to 2 dB and the time delay is greater than or equal to 100 microseconds, then we accept (emphasise) that frequency bin. If the magnitude difference is less than 2 dB and/or the time delay is less than 100 microseconds, then we reject (deemphasize) that frequency bin.

A user input 36 may be manipulated to vary the acceptance angle threshold(s) and a user input 30 may be manipulates to vary the distance threshold(s) as required by the user. In one embodiment a small number of user presets are provided for different acceptance patterns which the user can select as needed. For example, the user would select between general categories such as narrow or wide for the angle setting and near or far for the distance setting.

A visual or other indication is given to the user to let her know the threshold settings for angle and distance. Accordingly, user-variable threshold values can be provided such that a user can adjust a distance selectivity and/or an angle selectivity from the transducers. The user interface may represent this as changing the distance and/or angle thresholds, but in effect the user is adjust lug the magnitude difference and/or the time difference thresholds.

When the magnitude difference and time delay both fall within the acceptance window for a particular frequency hand, a relatively high gain is calculated at a block 40, and when one or both of the parameters is outside the window, a relatively low gain is calculated. The high gain is set at about 1 while the low gain is at about 0. Alternatively, the high gain might be above 1 while the low gain is below the high gain. In general, a relative gain change is caused between those frequency bands whose parameter (magnitude and time delay) comparisons both fall on one side of their respective threshold values and those frequency bands where one or both parameter comparisons fall on the other side of their respective threshold values.

The gains are calculated for each frequency bin in each data block. The calculated gain may be further manipulated in other ways known to those skilled in the art to minimize the artifacts generated by such gain change. For example, the minimum gain can be limited to some low value, rather than zero. Additionally, the gain in any frequency bin can be allowed to rise quickly but fall more slowly using a fast attack slow decay filter. In another approach, a limit is set on now much the gain is allowed to vary from one frequency bin to the next at any given time.

On a frequency bin by frequency bin basis, the calculated gain, is applied to the frequency domain signal from a single transducer, for example transducer 12 (although transducer 14 could also be used), at a multiplier 42. Thus, sound sources in the acceptance window are emphasized relative to sources outside the window.

Using conventional block processing techniques, the modified signal is inverse FFT'd at a block 44 to transform the signal from the frequency domain back into the time domain. The signal is then, windowed, overlapped and summed with the previous blocks at a block 46. At a block 48 the signal is converted, from a digital signal back to an analog (output) signal. The output of block 48 is then sent to a conventional amplifier (not shown) and acoustic driver (i.e. speaker) (not shown) of a sound reinforcement system to produce sound. Alternatively, an input signal (digital) to block 48 or an output signal (analog) from block 48 can be (a) recorded on a storage medium (e.g. electronic or magnetic), (b) communicated by a transmitter (wired or wirelessly), or (c) further processed and used to present information on location of sound sources.

Figure 8:
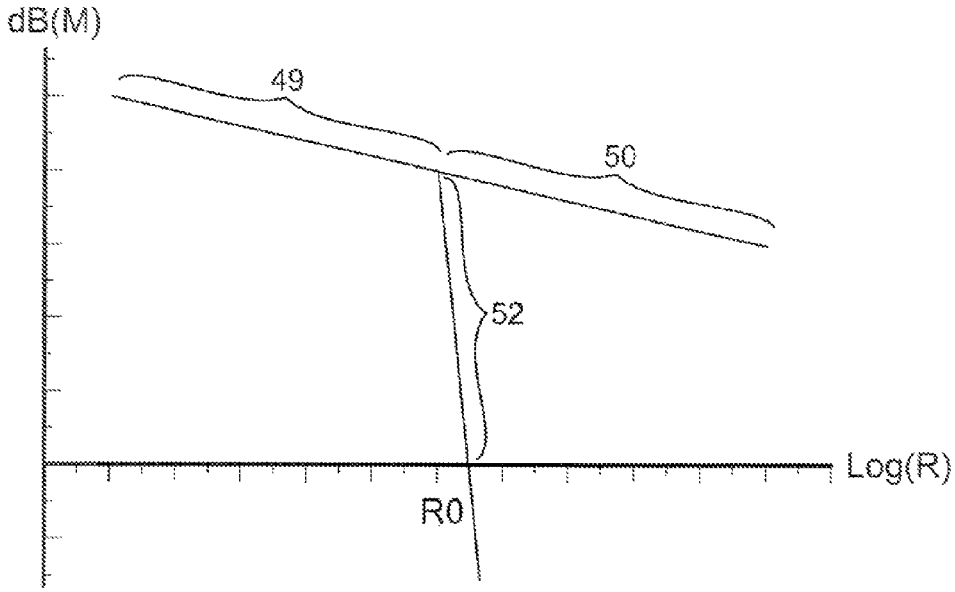
FIG. 8 is a plot of the output of a conventional microphone and the microphone system of FIG. 7 versus distance.

Some benefits of this microphone system will be described with respect to FIGS. 8 and 9. Regarding distance selectivity, the response of a conventional microphone decreases smoothly with distance. For example, for a sound source with, constant strength the output level of a typical, omni directional microphone falls with distance R as 1/R. This is shown as line segments 49 and 50 in FIG. 8 which plots relative microphone output in dB as a function of the log of R, the distance from the microphone to the sound source.

The microphone system shown in FIG. 7 has the same fall off with R (line segment 49), but only out to a specified distance, R0. The fall off in microphone output at R0 is represented by a fine segment 52. For a vocalist's microphone that is to be handheld by a singer, R0 would typically be set to be approximately 30 cm. For a vocalist's microphone fixed on a stand, that distance could be considerably less. The new microphone responds to the singer, located closer than R0, but rejects anything further away, such as sound from other instruments or loudspeakers.

Figure 9:
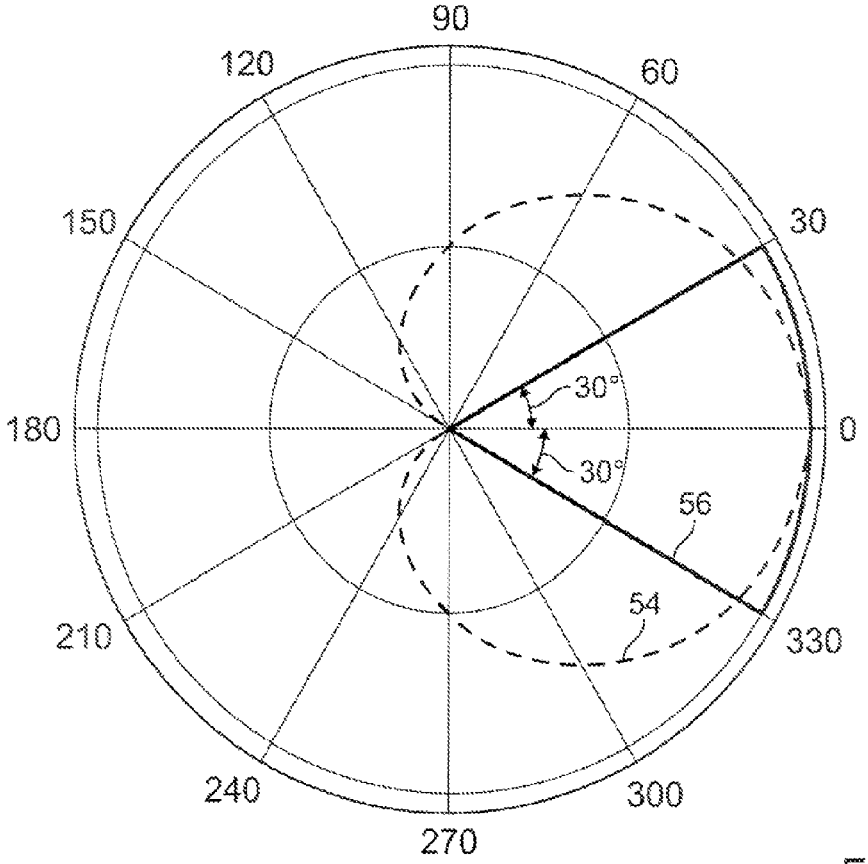
FIG. 9 is a polar plot of the output of a cardioid microphone and the microphone system of FIG. 7 versus angle.

Turning to FIG. 9, angle selectivity will be discussed. Conventional microphones can have any of a variety of directional patterns. A cardioid response, which is a common directional pattern for microphones, is shown in the polar plot line 54 (the radius of the curve indicates the relative microphone magnitude response to sound arriving at the indicated angle.) The cardioid microphone has the strongest magnitude response for sounds arriving at the front, with less and less response as the sound source moves to the rear. Sounds arriving from the rear are significantly attenuated.

A directional pattern for the microphone system of FIG. 7 is shown by the pie shaped line 56. For sounds arriving within the acceptance angle (in this example, ±30°), the microphone has high response. Sounds arriving outside this angle are significantly attenuated.

The magnitude difference is both a function of distance and angle. The maximum change in magnitude with distance occurs in line with the transducers. The minimum change in magnitude with distance occurs in a line perpendicular to the axis of the transducers. For sources 90 deg off axis, there is no magnitude difference, regardless of the source distance. Angle, however, is just a function of the time difference alone. For applications where distance selectivity is important, the transducer array should be oriented pointing towards the location of a sound source or sources we wish to select.

A microphone having this sort of extreme directionality will be much less susceptible to feedback than a conventional microphone for two reasons. First, in a live performance application, the new microphone largely rejects the sound, of main or monitor loudspeakers that may be present, because they are too distant and outside the acceptance window. The reduced sensitivity lowers the loop gain of the system, reducing the likelihood, of feedback. Additionally, in a conventional, system, feedback is exacerbated by having several "open" microphones and speakers on stage. Whereas any one microphone and speaker might be stable and not create feedback, the combination of multiple cross coupled systems can more easily be unstable, causing feedback. The new microphone system described herein is "open" only for a sound source within the acceptance window, making it less likely to contribute to feedback by coupling to another microphone and sound amplification system on stage, even if those other microphones and systems are completely conventional.

The new microphone system also greatly reduces the bleed through of sound from other performers or other instruments in a performing or recording application. The acceptance window (both distance and angle) can be tailored by the performer or sound crew on the fly to meet the needs of the performance.

The new microphone system can simulate the sound of many different styles of microphones for performers who want that effect as part of their sound. For example, in one embodiment of the invention this system can simulate the proximity effect of conventional microphones by boosting the gain more at low frequencies than high frequencies for magnitude differences indicating small R values. In the embodiment of FIG. 7, the output of transducer 12 alone is processed on a frequency bin basis to form an output signal. Transducer 12 is typically an omni-directional pressure responding transducer, and it will not exhibit proximity effect as is present in a typical pressure gradient responding microphone. Gain block 40 imposes a distance dependent gain function on the output of transducer 12, but the function described so far either passes or blocks a frequency bin depending on distance/angle from the microphone system. A more complex function can be applied in gain processing block 40, to simulate proximity effect of a pressure gradient microphone, while maintaining the distance/angle selectivity of the system as described. Rather than using a coefficient of either one or zero, a variable coefficient can be used, where the coefficient value varies as a function of frequency and distance. This function has a first order high pass filter shape, where the corner frequency decreases as distance decreases.

Proximity effect can also be caused by combining transducers 12, 14 into a single uni-directional or bi-directional microphone, thereby creating a fixed directional array. In this case the calculated gain is applied to the combined signal from transducers 12, 14, providing pressure gradient type directional behavior (not adjustable by the user), in addition to the enhanced selectivity of the processing of FIG. 7. In another embodiment of the invention the new microphone system does not boost the gain more at low frequencies than high frequencies magnitude differences indicating small R values and so does not display proximity effect.

The new microphone can create new microphone effects. One example is a microphone having the same output for all sound source distances within the acceptance window. Using the magnitude difference and time delay between the transducers 12 and 14, the gain is adjusted to compensate for the 1/R falloff from transducer 12. Such a microphone might be attractive to musicians who do not "work the mike". A sound source of constant level would cause the same output magnitude for any distance from the transducers within the acceptance window. This feature can be useful in a public address (PA) system. Inexperienced presenters generally are not careful about maintaining a constant distance from the microphone. With a conventional PA system, their reproduced voice can vary between being too loud and too soft. The improved microphone described herein keeps the voice level constant, independent of the distance between the speaker and the microphone. As a result, variations in the reproduced voice level for an inexperienced speaker are reduced.

The new microphone can be used to replace microphones for communications purposes, such as a microphone for a cell phone for consumers (in a headset or otherwise), or a boom microphone for pilots. These personal communication devices typically have a microphone which is intended to be located about 1 foot or less from a user's lips. Rather than using a boom to place a conventional noise canceling microphone close to the user's lips, a pair of small microphones mounted on the headset could use the angle and/or distance thresholds to accept only those sounds having the correct distance and/or angle (e.g. the user's lips). Other sounds would be rejected. The acceptance window is centered around the anticipated location of the user's mouth.

This microphone can also be used for other voice input systems where the location of the talker is known (e.g. in a car). Some examples include hands free telephony applications, such as hands free operation in a vehicle, and hands free voice command, such as with vehicle systems employing speech recognition capabilities to accept voice input from a user to control vehicle functions. Another example is using the microphone in a speakerphone which can be used, for example, in tele-conferencing. These types of personal communication devices typically have a microphone which is intended to be located more than 1 foot from a user's lips. The new microphone technology of this application can also be used in combination with speech recognition software. The signals from the microphone are passed to the speech recognition algorithm in the frequency domain. Frequency bins that are outside the accept region for sound sources are given a lower weighting than frequency bins that are in the accept region. Such an arrangement can help the speech recognition software to process a desired speakers voice in a noisy environment.

Figure 10A:
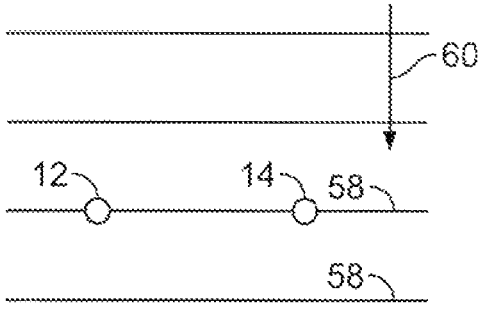
FIGS. 10*a* and 10*b* are schematic drawings of transducers being exposed to acoustic waves from different directions.

Turning now to FIGS. 10A and B, another embodiment will be described. In the embodiment described in FIG. 7, two transducers 12, 14 are used with relatively wide spacing between them compared to a wavelength of sound at the maximum, operating frequency of the transducers. The reasons for this will be discussed below. However, as the frequency gets higher, it becomes difficult to reliably estimate the time delay between the two transducers using computationally simple methods. Normally, the phase difference between microphones is calculated for each frequency bin and divided by the center frequency of the bin to estimate time delay. Other techniques can be used, but they are more computationally intensive.

However, when the wavelength of sound approaches the distance between the microphones, this; simple approach breaks down. The phase measurement produces results in the range between $-\pi$ and $\pi$. However, there is an uncertainty in the measurement having a value that is an integral multiple of $2\pi$, A measurement of 0 radians of phase difference could just as easily represent a phase difference of $2\pi$ or $-2\pi$.

Figure 10B:
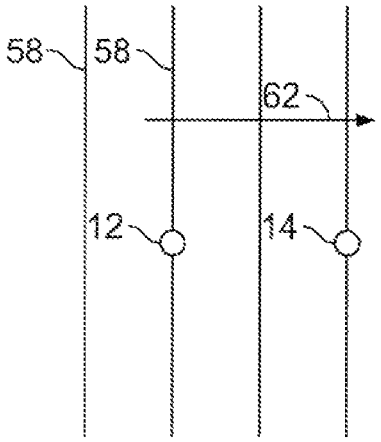

This uncertainty is illustrated graphically in FIGS. 10*a* and 10*b*. Parallel lines 58 represent the wavelength spacing of the incoming acoustic pressure waves. In both of FIGS. 10*a* and 10*b*, peaks in the acoustic pressure wave reach transducers 12, 14 simultaneously, and so a phase shift of 0 is measured. However, in FIG. 10*a* the wave comes in the direction of an arrow 60 perpendicular to an imaginary straight line joining transducers 12, 14. In this case the time delay actually is zero between the two transducers. On the contrary, in FIG. 10*b* the wave comes in parallel to the imaginary line joining transducers 12, 14 in the direction of an arrow 62. In this example, two wavelengths fit in the space between the two transducers. The time of arrival difference is clearly non-zero, yet the measured phase delay remains zero, rather than the correct value of $4\pi$.

This issue can be avoided by reducing the distance between transducers 12, 14 such that their spacing is less than a wavelength even for the highest frequency (shortest wavelength) we wish to sense. This approach eliminates the $2\pi$ uncertainty. However, a narrower spacing between the transducers decreases the magnitude difference between transducers 12, 14, making it harder to measure the magnitude difference (and thus provide distance selectivity).

Figure 11:
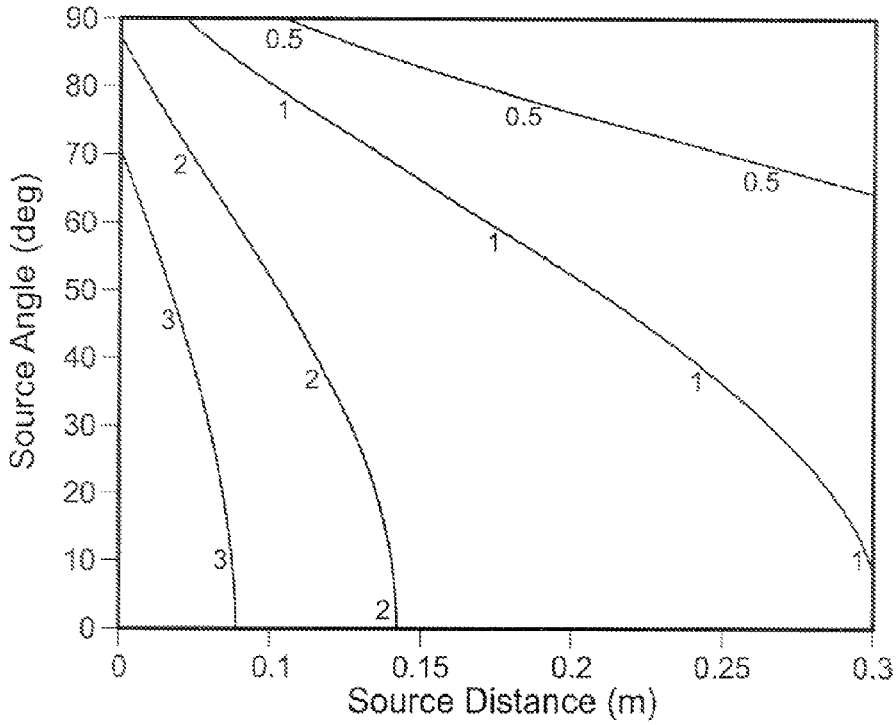
FIG. 11 is a plot of lines of constant magnitude difference (in dB) for a relatively widely spaced, pair of transducers.
Figure 12:
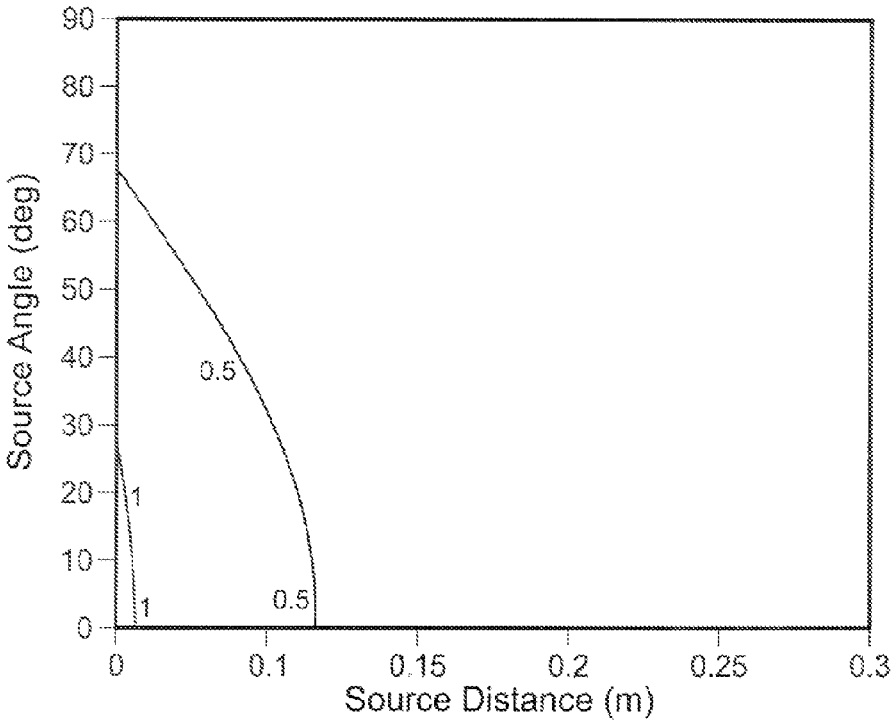
FIG. 12 is a plot of lines of constant magnitude difference (in dB) for a relatively narrowly spaced pair of transducers.

FIG. 11 show lines of constant magnitude difference (in dB) between transducers 12, 14 for various distances and angles between the acoustic source and transducer 12 when the transducers 12, 14 have a relatively wide spacing between themselves (about 35 mm). FIG. 12 shows lines of constant magnitude difference (in dB) between the transducers 12, 14 for various distances and angles to the acoustic source with a much narrower transducer spacing (about 7 mm). With narrower transducer spacing the magnitude difference is greatly reduced and it is harder to get an accurate distance estimate.

This problem can be avoided by using two pairs or transducer elements: a widely spaced pair for low frequency estimates of source distance and angle, and a narrowly spaced pair for high frequency estimates of distance and angle. In one embodiment only three transducer elements are used: widely spaced T1 and T2 for low frequencies and narrowly spaced T1 and T3 for high frequencies.

Figure 13:
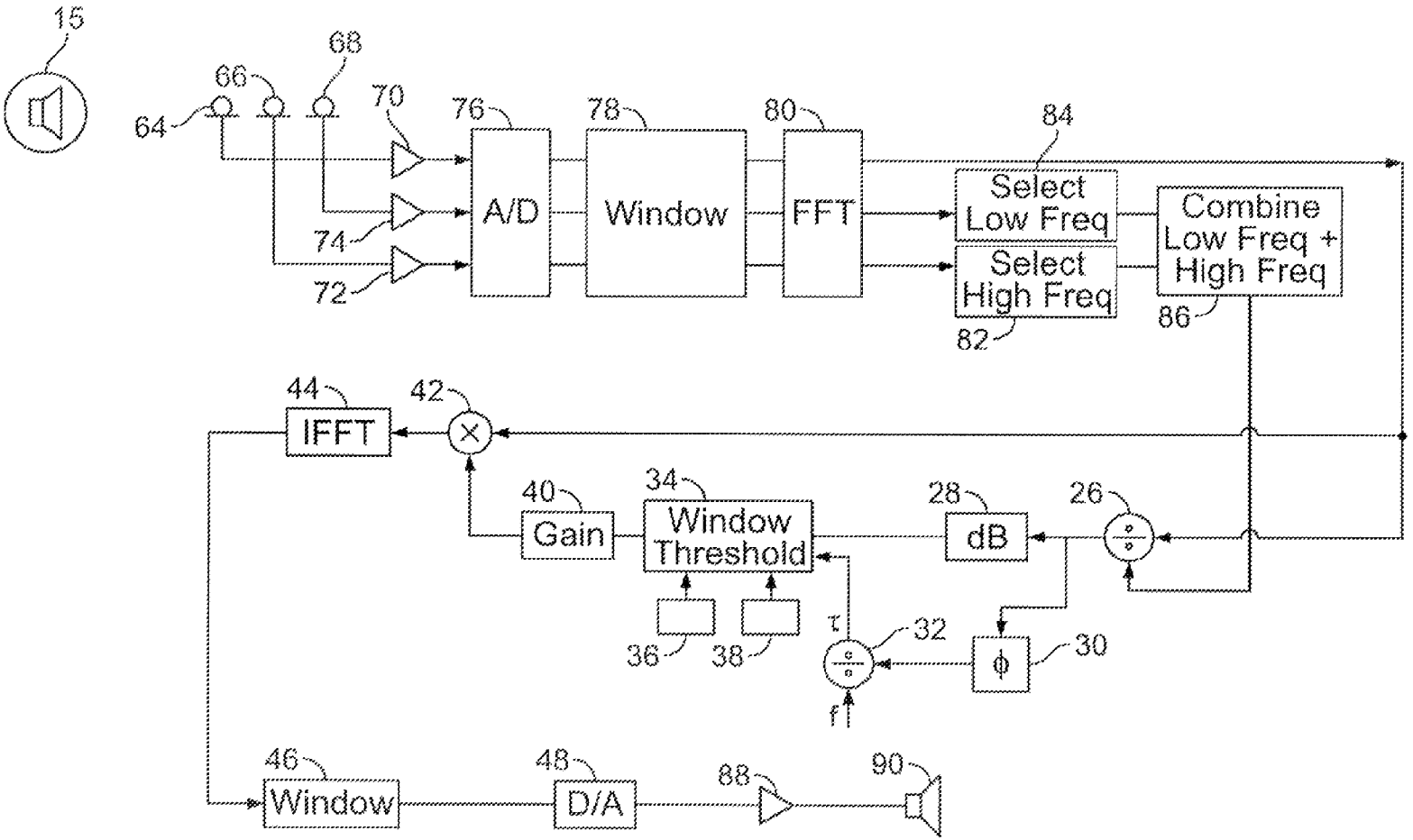
FIG. 13 is a schematic diagram of a second embodiment of a microphone system.

We will now turn to FIG. 13. Many of the blocks in the FIG. 13 are similar to blocks shown in FIG. 7. Signals from each of transducers 64, 66' and 63 pass through conventional, microphone preamps 70, 72 and 74. Each transducer is preferably an omni-directional microphone element. Note that the spacing between transducers 64 and 66 is smaller than the spacing between transducers 64 and 68. The three signal streams are then each converted from analog form to digital form by an analog-to-digital converter 76.

Each of the three signal streams receive standard block processing windowing at block 78 and are converted from the time domain to the frequency domain in at FIT block 80. High frequency bins above a pre-defined frequency from the signal of transducer 66 are selected out at block 32. In this embodiment the pre-defined frequency is 4 Khz. Low frequency bins at or below 4 khz from the signal of transducer 68 are selected out at block 34. The high frequency bins from block 82 are combined with the low frequency bins from block 84 at a block 86 in order to create a full complement of frequency bins. It should be noted that this band splitting can alternatively be done to the analog domain rather than the digital domain.

The remainder of the signal processing is substantially the same as for the embodiment in FIG. 7 and so will, not be described in detail. The ratio of the signal from, transducer 64 and the combined low frequency and high frequency signals out of block 86 is calculated. The quotient is processed as described with reference to FIG. 7. The calculated gain is applied to the signal from transducer 64, and the resulting signal is applied to standard inverse FFT, windowing, and overlap-and-sum blocks before being converted back to an analog signal by a digital-to-analog converter. In one embodiment, the analog signal is then sent to a conventional amplifier 86 and speaker 90 of a sound reinforcement system. This approach avoids the problem of the 2π uncertainty.

Figure 14:
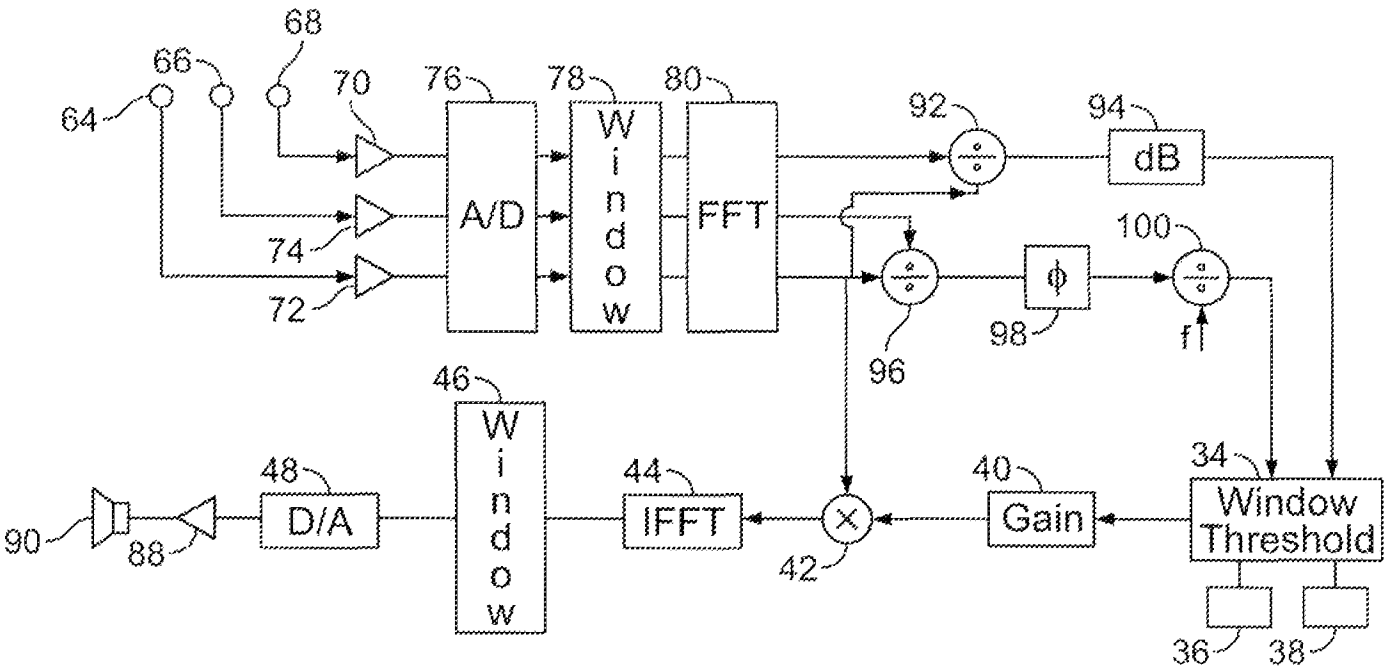

Turning to FIG. 14, another embodiment will be described, which avoids the problem of the 2π uncertainty. The front end of this embodiment is substantially the same as in FIG. 13 through FFT block 80. At this point the ratio of the signals from transducers (microphones) 64 and 68 (widely spaced) is calculated at divider 92 and the magnitude difference in dB is determined at block 94. The ratio of the signals from transducers 64 and 66 (narrowly spaced) is calculated at divider 96 and the phase difference is determined at block 98. The phase is divided by the center frequency of each frequency bin at a divider 100 to determine the time delay. The remainder of the signal processing is substantially the same as in FIG. 13.

In a still further embodiment based on FIG. 11, the magnitude difference in dB is determined the same way as in that Figure. However, the ratio of the signals from transducers 64 and 66 (narrowly spaced) is calculated at a divider for low frequency bins (e.g. at or below 4 khz) and the phase difference is determined. The phase is divided by the center frequency of each low frequency bin to determine the time delay. Further, the ratio of the signals from transducers 64 and 68 (widely spaced) is calculated at a divider for high frequency bins (e.g. above 4 khz) and the phase difference is determined. The phase is divided by the center frequency of each high frequency bin to determine the time delay.

Figure 15A:
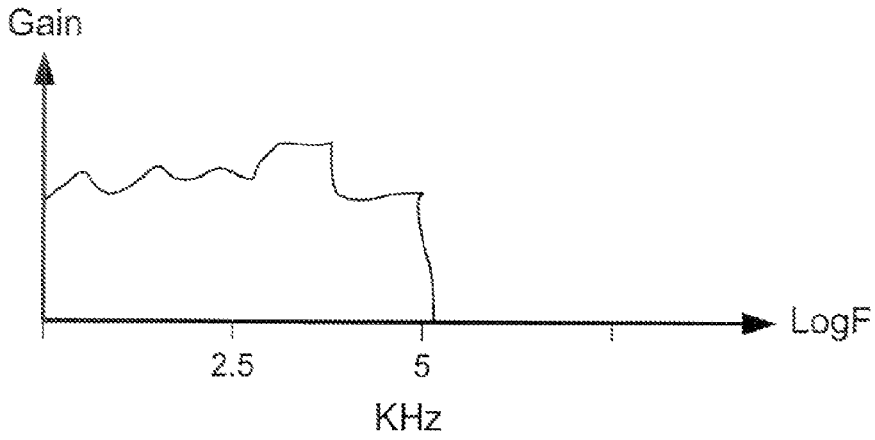
FIGS. 15*a* and *b* are plots of gain versus frequency.

With reference to FIGS. 15*a* and *b*, there is another embodiment that avoids the need for a third transducer. For transducer separations of about 30-35 mm, we are able to estimate the source location up to about 5 kHz. While frequencies above 5 kHz are important for high quality reproduction of music and speech and so can't be discarded, few acoustic sources generate energy only above 5 kHz. Generally, sound sources also generate energy below 5 kHz.

We can take advantage of this fact by not bothering to estimate source position above 5 kHz. Instead, if acoustic energy is sensed below 5 kHz that is within the acceptance window of the microphone, then energy above 5 Khz is also allowed to pass, making the assumption that it is coming from the same source.

One method, of achieving this goal is to use the instantaneous gains predicted for the frequency bins located in the octave between 2.5 and 5 kHz for example, and to apply those same or ins to the frequency bins one and two octaves higher, that is, for the bins between 5 and 10 kHz, and the bins between 10 and 20 kHz. This approach preserves any harmonic structure that may exist in the audio signal. Other initial octaves, such, as 2-4 kHz, can be used as long as they are commensurate with transducer spacing.

Figure 15B:
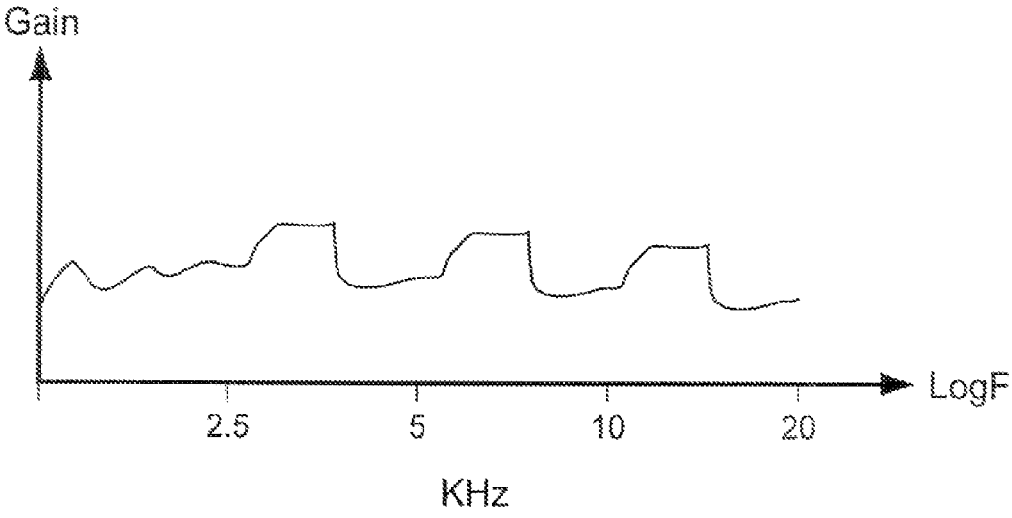

As shown in FIGS. 15*a* and *n*. The signal processing is substantially the same as in FIG. 7 except for "compare threshold" block 34 and its inputs. This difference will be described below. In FIG. 15*a*, the gain is calculated up to 5 kHz based on the estimated source position. Above 5 kHz, it is difficult to get a reliable source location estimate, because of the 2π uncertainty in phase described above. Instead, as shown in FIG. 15*b*, the gain in the octave from 2.5 to 5 kHz is repeated for frequency bins spanning the octave 5 to 10 kHz, and again for frequency bins spanning the octave 10 to 20 kHz.

Figure 16A:
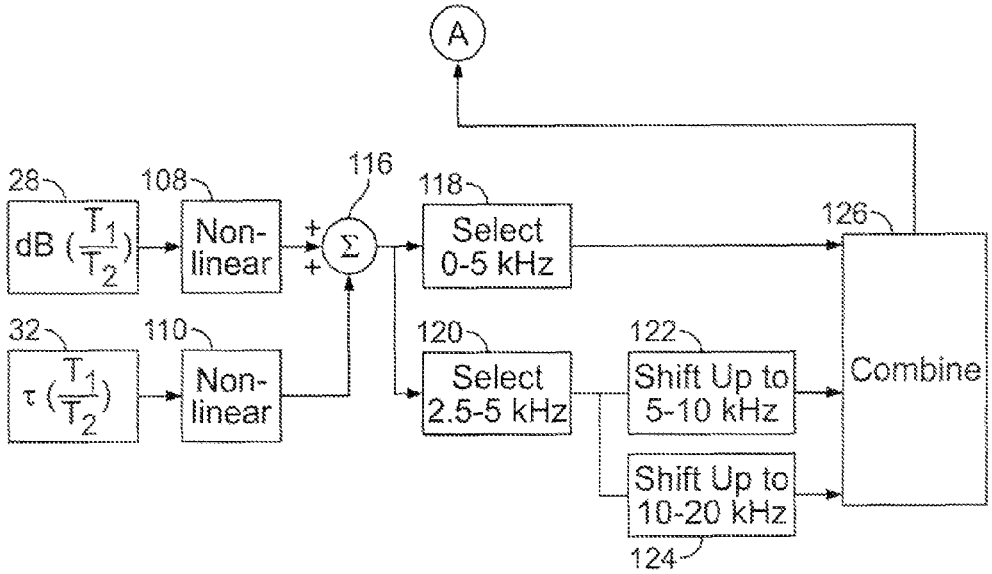
FIG. 16B is a schematic diagram of a fourth embodiment of a microphone system.
FIGS. 16C-E are graphs of gain terms used, in the fourth embodiment.

Implementation of this embodiment will be described with reference to FIG. 16A which replace the block 34 marked "compare threshold" in FIG. 7. The magnitude and time delay ratios out of block 28 and divider 32 (FIG. 7) are passed through respective non-linear blocks 108 and 110 (discussed in further detail below). Blocks 108 and 110 work independently for each frequency bin and for each block of audio data, and create the acceptance window for the microphone system. In this example only one threshold is used for time delay and only one threshold is used for magnitude difference.

Figure 16B:
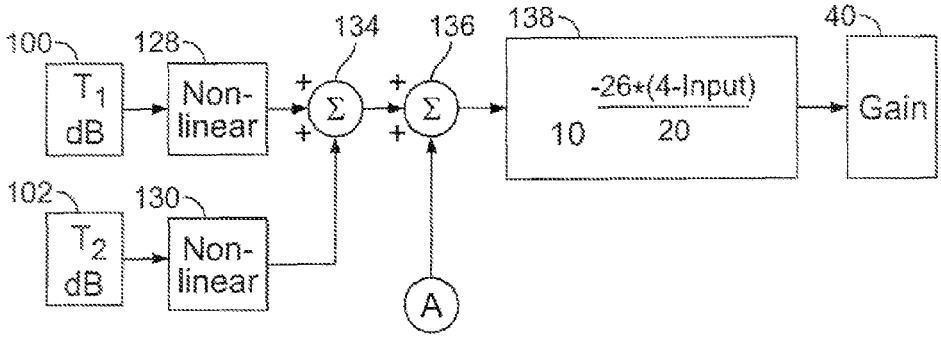

The two calculated gains out of blocks 108 and 110, based on magnitude and time delay, are summed at a summer 116. The reason for summing the gains will be described below. The summed gain for frequencies below 5 kHz is passed through at a block 118. The gain for frequency bins between 2.5 and 5 kHz is selected out at a block 120 and remapped (applied) into the frequency bins for 5 to 10 kHz at a block 122 and for 10 to 20 kHz at a block 124 (as discussed above with respect to FIGS. 15*a* and *b* above). The frequency bins for each of these three regions are combined at a block 126 to make a single full bandwidth complement of frequency bins. The output "A" of block 126 is passed on to further signal processing described in FIG. 16B. Good high frequency performance is allowed with two relatively widely spaced transducer elements.

Turning now to FIG. 168, another important feature of this example will be described. The respective magnitudes of the T1 signal 100 and of the T2 signal 102 in dB for each frequency bin on a block by block basis are passed through respective identical non-linear blocks 128 and 130 (discussed below in further detail). These blocks create low gain terms for frequency bins in which the microphones have a low signal level. When the signal level in a frequency bin is low for either microphone, the gain is reduced.

The two transducer level gain terms are summed with each other at a summer 131. The output of summer 134 is added at a summer 136 to the gain term (from block 126 of FIG. 16A) derived from the sum of the magnitude gain term and the time gain term. The terms are summed at summers 134 and 136, rather than multiplied, to reduce the effects of errors in estimating the location of the source. If all four gain terms are high (i.e. 1) in a particular frequency bin, then that frequency is passed through with unity (1) gain. If any one of the gain terms falls (i.e. is less than 1), the gain is merely reduced, rather than shutting down the gain of that frequency bin completely. The gain is reduced sufficiently so that the microphone performs its intended function, of rejecting sources outside of the acceptance window in order to reduce feedback and bleed-through. However, the gain reduction is not so large as to create audible artifacts should the estimate of one of the parameters be erroneous. The gain in that frequency bin is turned down partially, rather than fully, making the audible effects of estimation errors significantly less audible.

The gain term output by summer 136, which has been calculated in dB, is converted to a linear gain at a block 138, and applied to the signal from transducer 12, as shown in FIG. 7. In this embodiment and other embodiments discussed in this application audible artifacts due to poor estimates of the source location are reduced.

Figure 16C:
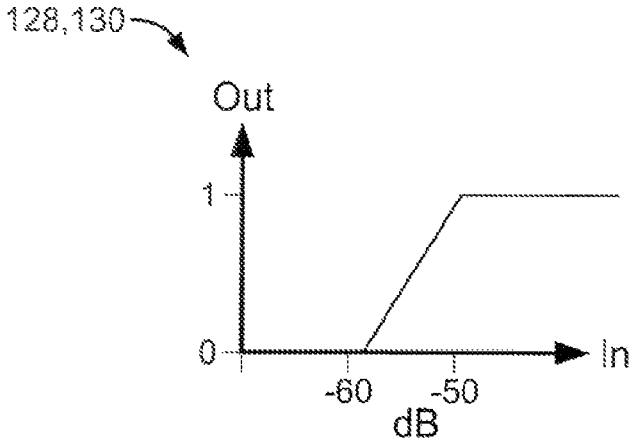
Figure 16D:
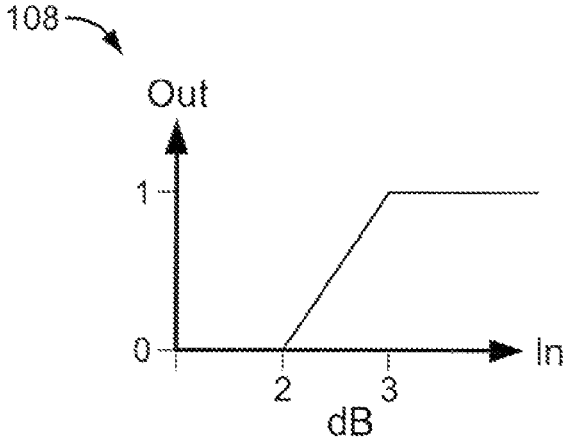
Figure 16E:
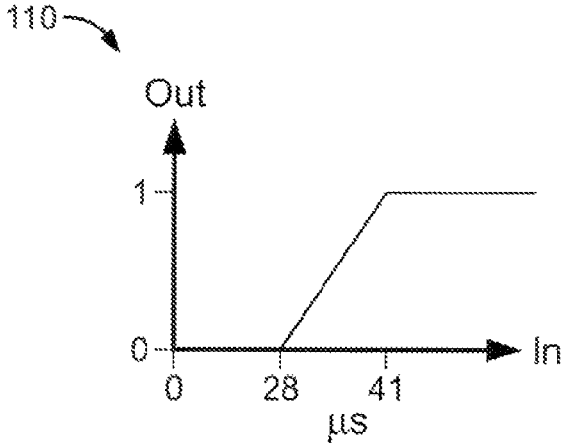

Details of non-linear blocks 108, 110, 123 and 130 will now be discussed with reference to FIGS. 16C-E. This example assumes a spacing between the transducers 12 and 14 of about 35 mm. The values provided below will change if the transducer spacing changes to something other than 35 mm. Each of blocks 108, 110, 128 and 130, rather than being only full-on or full-off (e.g. gain of 1 or 0), have a short transition region, which fades acoustic sources across a threshold as they pass in and out of the acceptance window. FIG. 16E shows that, regarding block 110, for time delays between 28-41 microseconds the output gain rises from 0 to 1. For time delays less than 28 microseconds the gain is 0 and for time delays greater than 41 microseconds the gain, is 1. FIG. 16D shows that, regarding block 108, for magnitude differences between 2-3 dB the output gain rises from 0 to 1. Below 2 dB the gain is 0 and above 3 dB the gain is 1. FIG. 16C shows a gain term that is applied by blocks 128 and 130. In this example, for signal levels below −60 dB a 0 gain is applied. For signal levels from −60 dB to −50 dB the gain increases from 0 to 1. For a transducer signal level above −50 dB the gain is 1.

The microphone systems described above can be used in a cell phone or speaker phone. Such a cell phone or speaker phone would also include an acoustic driver for transmitting sound to the user's ear. The output of the signal processor would be used to drive a second acoustic driver at a remote location to produce sound (e.g. the second acoustic driver could be located in another cell phone or speaker phone 500 miles away).

A still further embodiment of the invention will now be described. This embodiment relates to a prior art boom microphone that is used to pick up the human voice with a microphone located at the end of a boom worn on the user's head. Typical applications are communications microphones, such as those used by pilots, or sound reinforcement microphones used by some popular singers in concert. These microphones are normally used when one desires a hands-free microphone located close to the mouth in order to reduce the pickup of sounds from other sources. However, the boom across the face can be unsightly and awkward. Another application of a boom microphone is for a cell phone headset. These headsets have an earpiece worn on or in the user's ear, with a microphone boom suspended from the earpiece. This microphone may be located in front of a users mouth or dangling from a cord, either of which can be annoying.

Figure 17A:
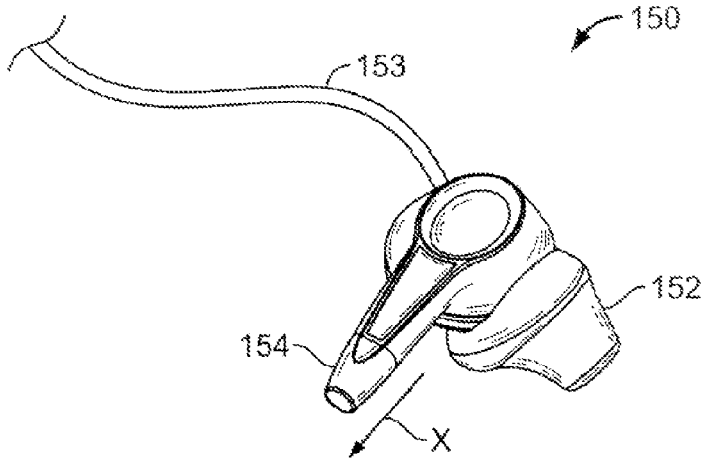
FIG. 17A ft is a perspective view of an earphone with integrated microphone.

An earpiece using the new directional technology of this application is described with reference to FIG. 17. An earphone 150 includes an earpiece 152 which is inserted into the ear. Alternatively, the earpiece can be placed on or around the ear. The earphone includes an internal speaker (not shown) for creating sound which passes through the ear piece. A wire bundle 153 passes DC power from, for example, a cell phone clipped to a users belt to the earphone 150. The wire bundle also passes audio information into the earphone 150 to be reproduced by the internal speaker. As an alternative, wire bundle 153 is eliminated, the earpiece 152 includes a battery to supply electrical power, and information is passed to and from the earpiece 152 wirelessly. Further included in the earphone are a microphone 154 that includes two or three transducers (not shown) as described above. Alternatively, the microphone 154 can be located separately from the earpiece anywhere in the vicinity of the head (e.g. on a headband of a headset). The two transducers are aligned along a direction X so as to be aimed in the general direction of the users mouth. The transducers may be part of a MEMS technology may be used to provide a compact, light microphone 154. The wire bundle 153 passes signals from the transducers back to the cell phone where signal processing described above is applied, to these signals. This arrangement eliminates, the need for a boom. Thus, the earphone unit is smaller, lighter weight, and less unsightly. Using the signal processing disclosed above (e.g. in FIG. 7), the microphone can be made to respond preferentially to sound coming from the user's mouth, while rejecting sound from other sources (e.g. the speaker in the earphone 150). In this way, the user gets tins benefits of having a boom microphone without the need for the physical boom.

For previous embodiments described above, the general assumption was that of a substantially free field acoustic environment. However, near the head, the acoustic field from sources is modified by the head, and free-field conditions no longer hold. As a result, the acceptance thresholds are preferably changed from free field conditions.

At low frequencies, where the wavelength of sound is much larger than the head, the sound field is art greatly changed, and an acceptance threshold similar to free field may be used. At high frequencies, where the wavelength of sound is smaller than the head, the sound field is significantly changed by the head, and the acceptance thresholds must be changed accordingly.

In this kind of application, it is desirable for the thresholds to be a function of frequency. In one embodiment, a different threshold is used for every frequency bin for which the gain is calculated. In another embodiment, a small number of thresholds are applied to groups of frequency bins. These thresholds are determined empirically. During a calibration process, the magnitude and time delay differences in each frequency bin are continually recorded while a sound source radiating energy at all frequencies of interest is moved around the microphone. A high score is assigned to the magnitude and time difference pairs when the source is located in the desired acceptance zone and a low score when if is outside the acceptance zone. Alternatively, multiple sound sources at various locations can be turned on and off by the controller doing the scoring and tabulating.

Using well known statistical methods for minimizing error, the thresholds for each frequency din are calculated using the db difference and time (or phase) difference as the independent variables, and the score as the dependent variable. This approach compensates for any difference in frequency response that may exist between the two microphone elements that make up any given unit.

An issue to consider is that microphone elements and analog electronics have tolerances, so the magnitude and phase response of two microphones making up a pair may not be well matched. In addition, the acoustical environment in which the microphone is placed alters tins magnitude and time delay relationships for sound sources in the desired acceptance window.

In order to address these issues an embodiment is provided in which the microphone learns what the appropriate thresholds are, given the intended use of the microphone, and the acoustical environment. In the intended acoustic environment with a relatively low level of background noise, a user switches the system to a learning mode and moves a small sound source around in a region that the microphone should accept sound sources when operating. The microphone system calculates the magnitude and time delay differences in all frequency bands during the training. When the data gathering is complete, the system calculates the best fit of the data, using well known statistical methods and calculates a set of thresholds for each frequency bin or groups of frequency bins. This approach assists in attaining an increased number of correct decisions about sound source location made for sound sources located in a desired acceptance zone.

A sound source used for training could be a small loudspeaker playing a test signal that contains energy in all frequency bands of interest during the training period, either simultaneously, or sequentially. If the microphone is part of a live music system, the sound source can be one of the speakers used as a part of the live music reinforcement system. The sound source could also be a mechanical device that creates noise.

Alternately, a musician can use their own voice or instrument as the training source. During a training period, the musician sings or plays their instrument, positioning the mouth or instrument in various locations within the acceptance zone. Again, the microphone system calculates magnitude and time delay differences in all frequency bands, but rejects any bands for which there is little energy. The thresholds are calculated using best fit approaches as before, and bands which have poor information are tilled in by interpolation from nearby frequency bands.

Once the system has been trained, the user switches the microphone back to a normal operating mode, and it operates using the newly calculated thresholds. Further, once a microphone system is trained to be approximately correct, a check of the microphone training is done periodically throughout the course of a performance (or other use), using the music of the performance as a test signal.

Figure 17B:
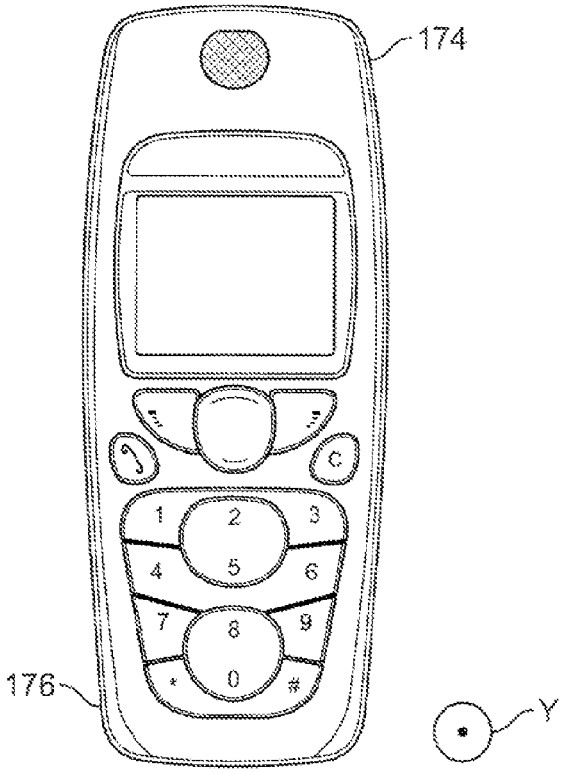
FIG. 17B is a front view of a cell phone with integrated microphone.

FIG. 17B discloses a cell phone 174 which incorporates two microphone elements as described herein. These two elements are located toward a bottom end 176 of the microphone 174 and are aligned in a direction Y that extends perpendicular to the surface of the paper on which FIG. 17B lies. Accordingly, the microphone elements are aimed in the general direction of the cell phone users mouth.

Figure 18A:
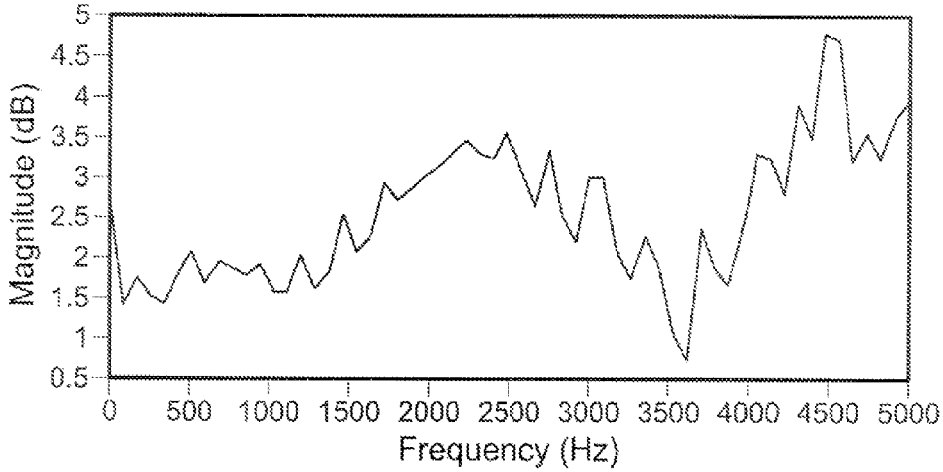
FIGS. 18A and B are plots of frequency verses threshold for magnitude and time delay.
Figure 18B:
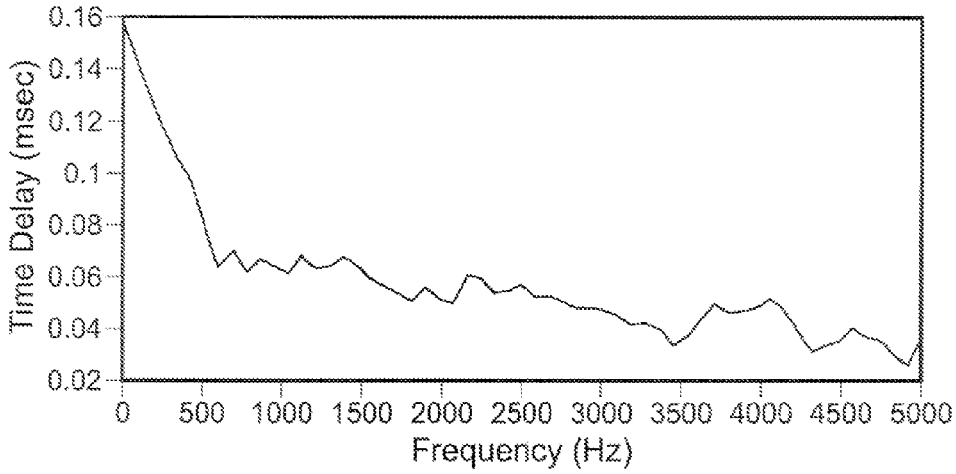

Referring to FIGS. 18A and B, two graphs are shown which plot frequency verses magnitude threshold (FIG. 18A) and time delay threshold (FIG. 18B) for a "boomless" boom mike. In this embodiment a microphone with two transducers to one of the ear cups of a headset such as the QC2® Headset available from Rose Corporation®. This headset was placed on the head of a mannequin which, simulates the human head, torso, and voice. Test signals were played through the mannequin's mouth, and the magnitude and time differences between the two microphone elements were acquired and given a high score, since these signals represent the desired signal in a communications microphone. In addition, test signals were played through another source which was moved to a number of locations around the mannequin's head. Magnitude and time differences were acquired and given a low score, since these represent undesired jammers. A best fit algorithm was applied to the data, in each frequency bin. The calculated magnitude and time delay thresholds for each bin are shown in the plots of FIGS. 18A and B. In a practical application, these thresholds could be applied to each bin, as calculated. In order to save memory, it is possible to smooth these plots, and use a small number of thresholds on groups of frequency bins. Alternatively a function is fit to the smoothed curve and used to calculate the gains. These thresholds are applied in, for example, block 31 of FIG. 7.

In another embodiment of the invention, slew rate limiting is used in the signal processing. This embodiment is similar to the embodiment of FIG. 7 except that slew rate limiting is used in block 40. Slew rate limiting is a non-linear method for smoothing noisy signals. When applied to the embodiments described above, the method, prevents the gain control signal (e.g. coming out of block 40 in FIG. 7) from changing too fast, which could cause audible artifacts. For each frequency bin, the gain control signal is not permitted to change more than a specified value from one block to the next. The value may be different for increasing gain than for decreasing gain. Thus, the gain actually applied to the audio signal (e.g. from transducer 12 in FIG. 7) from the output of the slew rate limiter (in block 40 of FIG. 7) may lag behind the calculated gain.

Figure 19:
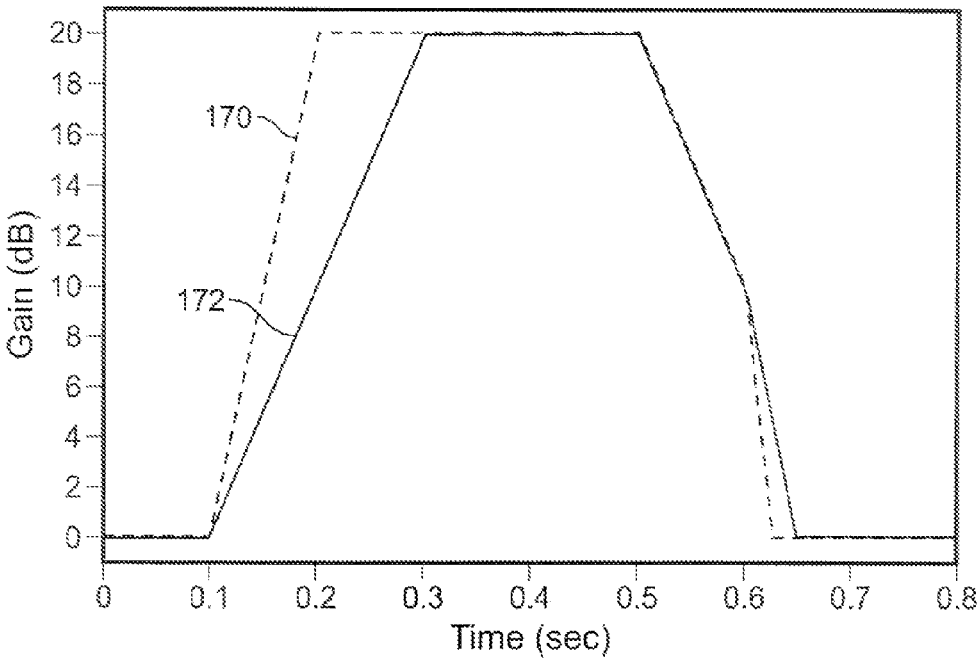
FIG. 19 is a graph demonstrating slew rate limiting.

Referring to FIG. 19, a dotted line 170 shows the calculated gain for a particular frequency bin plotted versus time. A solid line 172 shows the slew rate limited gain that results after slew rate limiting is applied, in this example, the gain is not permitted to rise faster than 100 db/sec, and not permitted to fall faster than 200 dB/sec. Selection of the slew rate is determined by competing factors. The slew rate should be as fast as possible to maximise rejection of undesired acoustic sources. However, to minimise audible artifacts, the slew rate should be as slow as possible. The gain can be slewed down more slowly than up based on psychoaconstic factors without problems.

Thus between t=0.1 and 0.3 seconds, the applied gain (which has been slew rate limited) lags behind the calculated gain because the calculated gain is rising faster than the threshold. Between t=0.5 and 0.6, the calculated and applied gains are the same, since the calculated gain is falling at a rate less than the threshold. Beyond t=0.6, the calculated gain is falling faster than threshold, and the applied gain lags once again until it can catch up.

Another example of using more than two transducers is to create multiple transducers pairs whose sound source distance and angle estimates can be compared. In a reverberant sound field, the magnitude and phase relationships between the sound pressure measured at any two points due to a source can differ substantially from those same two points measured in a free field. As a result, for a source in one particular location in a room, and a pair of transducers in another particular location in the room, the magnitude and phase relationship at one frequency can fall within the acceptance window, even though the physical location of the sound source is outside the acceptance window. In this case, the distance and angle estimate is faulty. However, in a typical room, the distance and angle estimate for that same frequency made just a short distance away is likely to be correct. A microphone system using multiple pairs of microphone elements can make multiple simultaneous estimates of sound source distance and angle for each frequency bin, and reject those estimates that do not agree with the estimates from the majority of other pairs.

Figure 20:
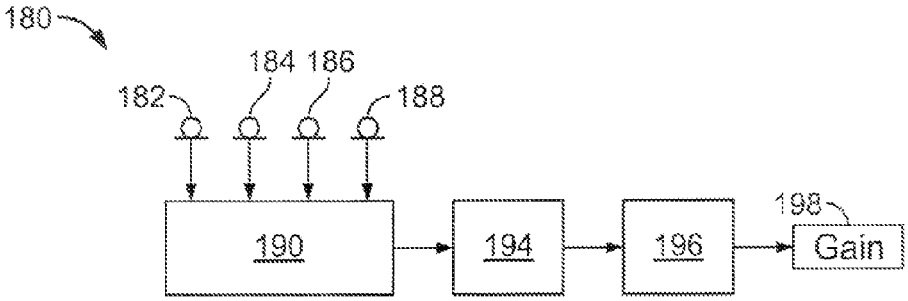
FIG. 20 is a side schematic diagram of a fifth embodiment of a microphone system.

An example of the system described in the previous paragraph will, be discussed with reference to FIG. 20. A microphone system 180 includes four transducers 182, 184, 186 and 188 arranged in a linear array. The distance between each adjacent pair of transducers is substantially the same. This array has three pair of closely spaced transducers 182-184/184-186/186-188, two pair of moderately spaced transducers 182-186/184-188 and one pair of distantly spaced transducers 182-188. The output signals for each of these six pairs of transducers is processed, for example, as described above with reference to FIG. 7 (up to box 34) in a signal processor 190. An accept or reject decision is made for each pair for each frequency. In other words it is determined for each transducer pair whether the magnitude relationship (e.g. ratio) falls on one side or the other side of a threshold value The accept or reject decision for each pair can be weighted in a box 194 based on various criteria known, to those skilled in the art. For example, the widely spaced transducer pair 132-

138 can be given little weight at high frequencies. The weighted accepts are combined and compared to the combined weighted rejects in a box 196 to make a final accept or reject decision for that frequency bin. In other words, it is decided whether an overall magnitude relationship falls on one side or the other side of the threshold value. Based on this decision, gain is determined at a box 198 and this gain is applied to the output signal of one of the transducers as in FIG. 7. This system makes fewer false positive errors in accepting a sound source in a reverberant room.

Figure 21:
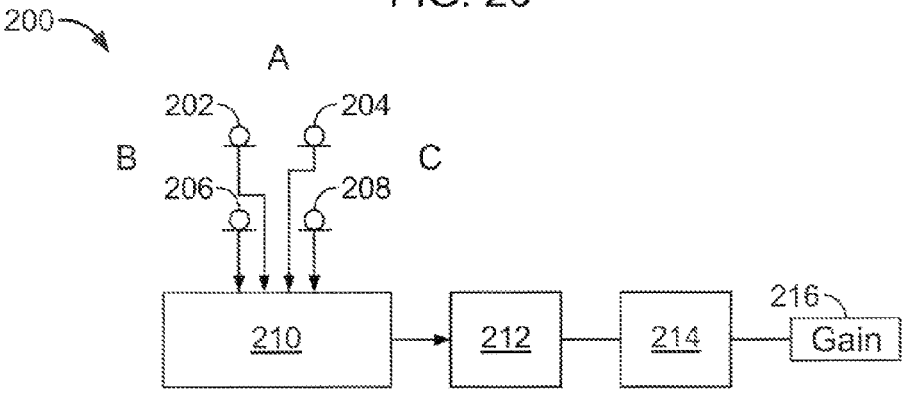
FIG. 21 is a top schematic diagram of a sixth embodiment of a microphone system.

In another example described with reference to FIG. 21, a microphone system 200 includes four transducers 202, 204, 206 and 208 arranged at the vertices of an imaginary four-sided polygon. In this example the polygon is in the shape of a square, but the polygon can be in a shape other than a square (e.g. a rectangle, parallelogram, etc.). Additionally, more than four transducers can be used at the vertices of a five or more sided polygon. This system has two forward facing pairs 202-206/204-208 facing a forward direction "A", two sideways facing pairs 202-204/206-208 facing sides B and C, and two diagonally facing pairs 204-206/202-208. The output signals for each pair of transducers are processed in a box 210 and weighted in a box 212 as described in the previous paragraph. A final accept or reject decision is made, as described above in a box 214, and a corresponding gain is selected for the frequency of interest at a box 216. This example allows the microphone system 200 to determine sound source distance even for sound sources 90° off axis located, for example, at locations B and/or C. Of course, more than four transducers can be used. For example, five transducers forming ten pairs of transducers can be used. In general, using more transducers results in a more accurate determination of sound source distance and angle.

In a further embodiment, one of the four transducers (e.g. omni-directional microphones) 202, 204, 206 and 208 is eliminated. For example, if transducer 202 is eliminated, we will have transducers 204 and 208 which can be connected by an imaginary straight line that extends to infinity in either direction, and transducer 206 which is located away from this line. Such an arrangement results in three pair of transducers 204-208, 206-208 and 204-206 which, can be used to determine sound source distance and angle.

The invention has been described with reference to the embodiments described, above. However, if will be appreciated that variations and modifications can be effected by a person of ordinary skill in the art without departing from the scope of the invention.

The invention claimed is:

1. A method of distinguishing sound sources, comprising the steps of:

transforming data, collected by a plurality of transducers which each react to a characteristic of an acoustic wave, into a plurality of signals, one for each respective transducer, the transducers being separated by a distance of less than about 70 mm or greater than about 90 mm, the plurality of transducers having a location;

separating each of the plurality of signals into a corresponding plurality of frequency bands;

for each frequency, comparing a magnitude difference of corresponding frequency bands of the plurality of signals to a predetermined first magnitude difference threshold value, the magnitude difference threshold value associated with a predetermined distance from the location of the plurality of the transducers; and causing, for a first signal of the plurality of signals, a relative gain change for a first set of frequency bands relative to a second set of frequency bands of the corresponding frequency bands of the first signal, the first set of frequency bands including frequency bands where the magnitude difference falls on one side of the magnitude difference threshold value, the second set of frequency bands including frequency bands where the magnitude difference falls on the other side of its the magnitude difference threshold value, such that the sound sources are discriminated from each other based on their distance from the transducers.

2. The method of claim 1, wherein the separating step includes using a fast Fourier transform to convert the signals from a time domain to a frequency domain.

3. The method of claim 1, further comprising the step of;

after the causing step converting the frequency bands into output signals.

4. The method of claim 1, further comprising the step of:

providing a user-variable magnitude difference threshold value such that a user can adjust the distance discrimination from the location of the plurality of transducers.

5. The method of claim 1, wherein the characteristic is a local sound pressure, its first-order gradient, higher-order gradients, or combinations thereof.

6. The method of claim 1, further comprising the step of:

providing a second magnitude difference threshold value different from the first magnitude difference threshold value, wherein the causing step causes a relative gain change between those frequency bands whose magnitude difference comparison falls in a first range between the first and second magnitude difference threshold values and those frequency bands whose magnitude difference comparison falls outside the first range.

7. The method of claim 6, further comprising the step of:

providing third and fourth magnitude difference threshold values that define a second range that is different from and does not overlap the first range, wherein the causing step causes a relative gain change between those frequency bands whose magnitude difference comparison falls in the first or second ranges and those frequency bands whose magnitude difference comparison falls outside the first and second ranges.

8. The method of claim 1, wherein a pair of the plurality of the transducers are separated by a distance of no less than about 250 microns, where the separation distance is measured between the centers of diaphragms of the transducers.

9. The method of claim 1, wherein a pair of the plurality of transducers are separated by a distance of between about 20 mm to about 50 mm, where the separation distance is measured between the centers of diaphragms of the transducers.

10. The method of claim 1, wherein the causing step fades the relative gain change between a low gain and a high gain.

11. The method of claim 1, wherein the acoustic wave is traveling in a substantially incompressible fluid.

12. The method of claim 1, wherein the causing step causes a relative gain change to a composite signal formed as a combination of signals of the plurality of signals.

13. The method of claim 1, wherein for a particular frequency band there is a limit in how quickly a gain for that frequency band can change.

14. The method of claim 13, wherein there is a first limit for how quickly the gain can increase and a second limit for how quickly the gain can decrease, the first limit and second limit being different.

15. A method of discriminating between sound sources, comprising the steps of:

transforming data, collected by a plurality of transducers which each react to a characteristic of an acoustic wave, into a plurality of signals, one for each respective transducer, the plurality of transducers having a location;

separating each of the plurality of signals into a corresponding plurality of frequency bands;

for each frequency, comparing a magnitude difference of corresponding frequency bands of the plurality of signals to a predetermined magnitude difference threshold value, the magnitude difference threshold value associated with a predetermined distance from the location of the plurality of the transducers;

for each frequency, comparing a time difference of corresponding frequency bands of the plurality of signals to a predetermined time difference threshold value, where the time difference is the difference in time between when an acoustic wave emitted by a sound source at a distance from the location of the plurality of transducers is detected by a first transducer of the plurality of transducers and when this wave is detected by a second transducer of the plurality of transducers, where the time difference threshold value is associated with a predetermined angle relative to the location of the plurality of transducers; and causing, for a first signal of the plurality of signals, a relative gain change for a first set of frequency bands relative to a second set of frequency bands of the corresponding frequency bands of the first signal, the first set of frequency bands including frequency bands where the magnitude difference and the time difference fall on one side of respective threshold values for magnitude difference and time difference, the second set of frequency bands including frequency bands where (a) the magnitude difference falls on the other side of the respective magnitude difference threshold value, (b) the time difference falls on the other side of the respective time difference threshold value, or (c) the magnitude difference and time difference both fall on the other side of their respective magnitude difference and time difference threshold values, such that the sound sources are discriminated from each other based on their distance and angle relative to the location of the plurality of transducers.

16. The method of claim 15, further comprising the step of;

providing an adjustable magnitude difference threshold value.

17. The method of claim 15, further comprising the step of;

providing an adjustable time difference threshold value.

18. The method of claim 17, further comprising the step of;

providing an adjustable magnitude difference threshold value.

19. The method of claim 15, wherein the causing step fades the relative gain change between a low gain and a high gain.

20. A method of discriminating between sound sources, comprising the steps of:

transforming data, collected by a plurality of transducers which each react to a characteristic of an acoustic wave, into a plurality of signals, one for each respective transducer, the plurality of transducers having a location;

separating each of the plurality of signals into a corresponding plurality of frequency bands;

for each frequency, comparing a magnitude difference of corresponding frequency bands of the plurality of signals to a predetermined magnitude difference threshold value, the magnitude difference threshold value associated with a predetermined distance from the location of the plurality of the transducers;

for each frequency, comparing a phase difference of corresponding frequency bands of the plurality of signals to a predetermined phase difference threshold value, the phase difference threshold value associated with a predetermined angle relative to the location of the plurality of transducers, causing, for a first signal of the plurality of signals, a relative gain change for a first set of frequency bands relative to a second set of frequency bands of the corresponding frequency bands of the first signal, the first set of frequency bands including frequency bands where the magnitude difference and phase difference fall on one side of respective threshold values for magnitude difference and phase difference, the second set of frequency bands including frequency bands where (a) the magnitude difference falls on the other side of the respective magnitude difference threshold value, (b) the phase difference falls on the other side of the respective phase difference threshold value, or (c) the magnitude difference and phase difference both fall on the other side of their respective magnitude difference and phase difference threshold values, such that the sound sources are discriminated from each other based on their distance and angle relative to the location of the plurality of transducers.

21. The method of claim 20, further comprising the step of;

providing an adjustable magnitude difference threshold value.

22. The method of claim 20, further comprising the step of;

providing an adjustable phase difference threshold value.

23. The method of claim 20, further comprising the step of;

providing an adjustable magnitude difference threshold value.

* * * * *